US006801742B1

(12) United States Patent
Mochimaru et al.

(10) Patent No.: US 6,801,742 B1
(45) Date of Patent: Oct. 5, 2004

(54) METHOD AND APPARATUS FOR PRODUCING DUPLEX PRINTS AND IMAGE FORMING SYSTEM USING THE SAME

(75) Inventors: Hideaki Mochimaru, Kanagawa (JP); Yasukuni Omata, Kanagawa (JP); Norimasa Sohmiya, Saitama (JP); Chiemi Kaneko, Ibaraki (JP); Yuzo Kouno, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/252,104

(22) Filed: Sep. 23, 2002

(30) Foreign Application Priority Data

| | | |
|---|---|---|
| Sep. 21, 2001 | (JP) | 2001-290284 |
| Sep. 25, 2001 | (JP) | 2001-290420 |
| Jan. 28, 2002 | (JP) | 2002-019287 |
| Aug. 22, 2002 | (JP) | 2002-241953 |
| Aug. 27, 2002 | (JP) | 2002-246463 |

(51) Int. Cl.[7] ..... G03G 15/20

(52) U.S. Cl. ..... 399/309; 399/66; 399/92; 399/94; 399/98; 399/124; 399/301; 399/302

(58) Field of Search ..... 399/309, 302, 399/308, 120–125, 107, 110, 111, 301, 66, 92, 94, 364, 374, 98

(56) References Cited

U.S. PATENT DOCUMENTS

| | | | | |
|---|---|---|---|---|
| 3,884,576 | A | 5/1975 | Mochimaru et al. | 355/69 |
| 3,901,586 | A | 8/1975 | Suzuki et al. | 359/726 |
| 4,056,320 | A | 11/1977 | Mochimaru et al. | 355/75 |
| 4,105,326 | A | 8/1978 | Mochimaru | 355/55 |
| 4,535,982 | A | 8/1985 | Mochimaru | 271/127 |
| 4,605,299 | A | 8/1986 | Mochimaru | 399/111 |
| 4,703,334 | A | 10/1987 | Mochimaru et al. | 347/130 |
| 4,753,543 | A | 6/1988 | Mochimaru et al. | 400/703 |
| 4,757,344 | A | 7/1988 | Idenawa et al. | 399/113 |
| 4,875,063 | A | 10/1989 | Idenawa et al. | 347/152 |
| 4,987,446 | A | 1/1991 | Mochimaru et al. | 399/113 |
| 5,089,855 | A | 2/1992 | Mochimaru | 399/297 |
| 5,138,389 | A | 8/1992 | Randall | 399/302 |
| 5,394,231 | A | 2/1995 | Sudo et al. | 399/228 |
| 5,453,822 | A | 9/1995 | Anzai et al. | 399/299 |
| 5,499,078 | A | 3/1996 | Kurokawa et al. | 399/31 |
| 5,559,590 | A | 9/1996 | Arai et al. | 399/314 |
| 5,570,162 | A | 10/1996 | Sohmiya | 399/174 |
| 5,594,540 | A | 1/1997 | Higaya et al. | 399/326 |
| 5,615,872 | A | 4/1997 | Mochimaru | 271/3.14 |

(List continued on next page.)

FOREIGN PATENT DOCUMENTS

| | | |
|---|---|---|
| DE | 32 17 461 | 11/1983 |
| EP | 1 202 131 | 5/2002 |
| EP | 1 215 544 | 6/2002 |
| EP | 1 237 056 | 9/2002 |
| JP | 59-111653 | 6/1984 |
| JP | 8-160703 | 6/1996 |
| JP | 9-258518 | 10/1997 |
| JP | 2000-081742 | 3/2000 |
| JP | 2001-075376 | 3/2001 |
| JP | 2002-040720 | * 2/2002 |

*Primary Examiner*—Sophia S. Chen
(74) *Attorney, Agent, or Firm*—Oblon, Spivak, McClelland, Maier & Neustadt, P.C.

(57) ABSTRACT

An image forming apparatus of the present invention includes a plurality of image carriers arranged along a first intermediate image transfer belt. Toner images of different colors formed on the image carriers are sequentially transferred to the first intermediate image transfer belt one above the other to complete a first image. The first image is transferred to a second image transfer belt and then transferred to one side of a sheet. At the same time, a second image completed on the first image transfer belt is directly transferred to the other side of the same sheet. First and second control means are respectively disposed in the loop of the first intermediate image transfer body and the loop of the second intermediate image transfer body. The apparatus of the present invention can form color images on both sides of the recording medium rapidly in accurate register.

85 Claims, 25 Drawing Sheets

U.S. PATENT DOCUMENTS 5,619,311 A 4/1997 Kurokawa et al. ..... 399/176
5,678,152 A 10/1997 Kohno et al. ..... 399/324
5,680,204 A * 10/1997 Ferrara ..... 399/364
5,832,354 A 11/1998 Kouno et al. ..... 399/330
5,915,147 A 6/1999 Kouno et al. ..... 399/69
6,038,410 A * 3/2000 Iriyama ..... 399/309 X
6,151,057 A 11/2000 Yamazaki et al. ..... 347/248
6,173,148 B1 1/2001 Matsuda et al. ..... 399/310
6,240,265 B1 * 5/2001 Noh ..... 399/92
6,308,019 B1 * 10/2001 Miyashiro et al. ..... 399/66
6,347,214 B1 2/2002 Kaneko ..... 399/397
2001/0031159 A1 * 10/2001 Ogiyama et al. ..... 399/302 X
2002/0015602 A1 * 2/2002 Mochimaru et al. ..... 399/309
2002/0037185 A1 * 3/2002 Mochimaru et al. ..... 399/309
2002/0090236 A1 * 7/2002 Omata et al. ..... 399/309
2002/0122679 A1 * 9/2002 Omata et al. ..... 399/309
2002/0131787 A1 * 9/2002 Shimizu et al. ..... 399/82
2003/0002881 A1 * 1/2003 Hirose et al. ..... 399/44
2003/0002892 A1 * 1/2003 Saito et al. ..... 399/302
2003/0016970 A1 * 1/2003 Omata et al. ..... 399/309 X

* cited by examiner

METHOD AND APPARATUS FOR PRODUCING DUPLEX PRINTS AND IMAGE FORMING SYSTEM USING THE SAME

BACKGROUND OF THE INVENTION

1. Field of the Invention

The present invention relates to a method of forming images on both sides of a single sheet or recording medium, an apparatus for practicing the method, and an image forming system using the apparatus.

2. Description of the Background Art

Various image forming apparatuses including electrophotographic copiers, facsimile apparatuses, printers and multiplex machines having at least two of their functions are extensively used today. For example, an image forming apparatus of the type capable of producing a duplex print carrying images on both sides thereof is known in the art. This type of apparatus transfers toner images of different colors formed on image carriers to one side of a sheet one above the other, fixes the resulting composite image, and then switches back, the sheet to thereby turn it. Subsequently, the apparatus again feeds the same sheet to the image carriers so as to transfer the next toner images of different colors from the image carriers to the other side of the sheet and then fixes the resulting composite image.

A problem with the image forming apparatus of the type described is that it has to switch back the sheet carrying the image on one side thereof and again feed it to the image carriers, resulting in a long image forming time and therefore low productivity. Another problem is that the sheet carrying the image only on one side thereof is apt to curl due to fixation, making conveyance unreliable.

Japanese Patent Laid-Open Publication No. 8-160703, for example, discloses an image forming apparatus capable of producing a duplex, color print with a single photoconductive element and two intermediate image transfer belts. This image forming apparatus includes a plurality of developing units each storing toner of particular color arranged around the photoconductive element. Toner images of different colors are sequentially formed on the photoconductive element while being sequentially transferred to a first intermediate image transfer belt one above the other, completing a full-color image. Subsequently, the full-color image is transferred from the first intermediate image transfer belt to a second intermediate image transfer belt. Thereafter, another full-color image is formed on the first intermediate image transfer belt in exactly the same manner as the previous full-color image. The two-full-color images are respectively transferred from the second and first belts to both sides of a sheet.

Japanese Patent Laid-Open Publication No. 9-258518 teaches a color image forming apparatus with a duplex print capability and also including a single photoconductive element and two intermediate image transfer belts. A plurality of developing units each storing toner of particular color are arranged around the photoconductive element. Exposure and development are repeated color by color to thereby form a full-color image on the photoconductive element. The full-color image is transferred from the photoconductive element to a first image transfer body and therefrom to a toner image acceptor or second intermediate image transfer body. Subsequently, another full-color image is transferred from the photoconductive element to the first intermediate image transfer body. The two full-color images are respectively transferred to opposite sides of a sheet from the toner image acceptor and first intermediate image transfer body.

However, the apparatus of Laid-Open Publication No. 8-160730 has the following problem left unsolved. In the full-color print mode, a toner image of one color is formed on the photoconductive element and transferred to the first intermediate image transfer body for a single rotation of the element, so that a single full-color image to be transferred to one side of a sheet is completed by four rotations of the element in total. Such a procedure is time-consuming and lower in productivity.

On the other hand, the apparatus of Laid-Open Publication No. 9-258518 uses four exposing units and four chargers for forming a full-color image on the photoconductive element and then transferring it to the intermediate image transfer body, reducing the image forming time. However, the exposing units are arranged within the photoconductive element, which is transparent for light. The photoconductive element therefore must be provided with a particular characteristic and a particular configuration and cannot be made compact. Further, a wasteful space exists around the intermediate image transfer body, increasing the overall size of the apparatus. In addition, charging and development repeated in the vicinity of a position where toner exists make it difficult to insure a stable image forming process.

Although the apparatuses of Laid-Open Publications stated above have some problems left unsolved, they solve to some extent the problem that the switchback of a sheet and the curl of a sheet ascribable to fixation obstruct reliable sheet conveyance. Neither one of them, however, gives consideration to the accurate register of images transferred to opposite sides of a sheet.

Moreover, assume that an intermediate image transfer belt or image carrier, which is passed over rollers, is brought to a stop at the same position every time image formation ends. Then, the belt is apt to curl complementarily to the circumference of each roller. The curl appears in the form of a projection on the belt and obstructs the close contact of an image carried on the belt and a sheet in the event of transfer, thereby rendering the image blurred or otherwise defective on the sheet. This is particularly true with a duplex print type image forming apparatus using non-contact type image transferring means.

SUMMARY OF THE INVENTION

It is an object of the present invention to provide a method and an apparatus capable of forming color images on both sides of a sheet in a short period of time, and an image forming system using the same.

It is another object of the present invention to provide a method and an apparatus capable of forming images on both sides of a sheet in accurate register, and an image forming system using the same.

It is a further object of the present invention to provide a method and an apparatus capable of insuring close contact of an intermediate image transfer belt and a sheet by obviating a curl to thereby obviate defective images, and an image forming system using the same. In accordance with the present invention, an image forming method begins with a step of electrostatically transferring toner images of different colors formed on a plurality of image carriers to a first intermediate image transfer body one above the other to thereby form a first composite image. The first composite image is electrostatically transferred from the first intermediate image transfer body to a second intermediate image transfer body and therefrom to one side of a sheet. A second composite image formed on the first intermediate image transfer body in exactly the same manner as the first image is electrostatically transferred from the first intermediate image transfer body to the other side of the same sheet. The first and second composite images are fixed on the recording medium at the same time.

Also, in accordance with the present invention, an image forming apparatus includes a plurality of image carriers on each of which a toner image of particular color is formed. Toner images of different colors formed on the image carriers are transferred to a first intermediate image transfer body one above the other to thereby form a first composite image. The first composite image is transferred from the first intermediate image transfer body to a second intermediate image transfer body. A first image transferring device electrostatically transfers the toner images from each image carrier to the first intermediate image transfer body. A second image transferring device electrostatically transferring the first composite image from the first intermediate image transfer body to the second intermediate image transfer body. A third image transferring device transfers the first composite image from the second image transfer body to one side of a sheet. A fourth image transferring device transfers to the other side of the recording medium a second composite image formed on the first intermediate image transfer body in exactly the same manner as the first composite. A fixing unit fixes the first and second composite images of the sheet at the same time.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
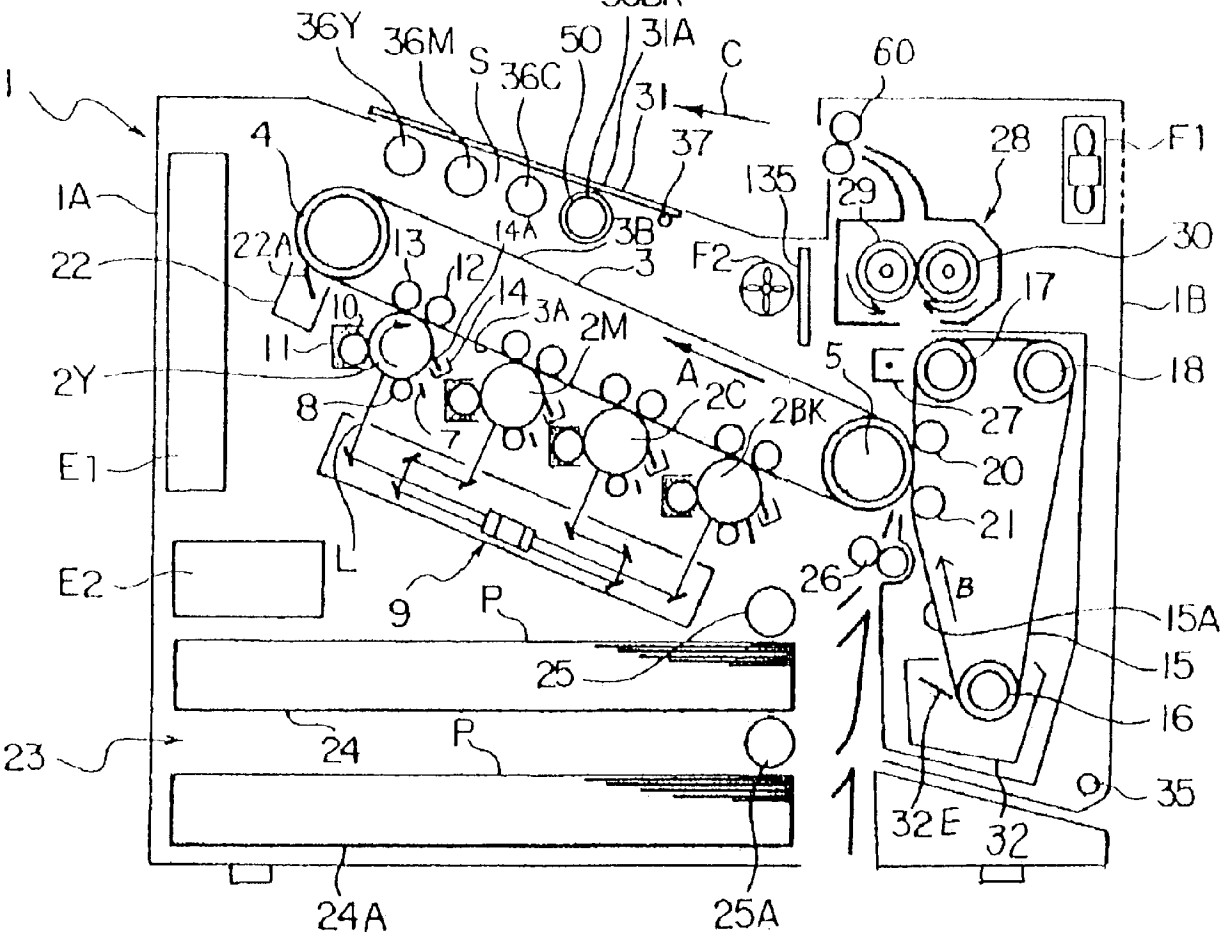
FIG. 1 is a vertical section showing a first embodiment of the image forming apparatus in accordance with the present invention.

Referring to FIG. 1 of the drawings, a first embodiment of the image forming apparatus in accordance with the present invention is shown and implemented as a printer by way of example. As shown, the printer includes a housing 1 in which a plurality of (four in the illustrative embodiment) photoconductive drums 2Y (yellow), 2M (magenta), 2C (cyan) and 2BK (black) are arranged side by side. The drums 2Y through 2BK are a specific form of image carriers. A toner image of particular color is to be formed on each of the drums 2Y through 2BK. While the colors of toner images to be formed on the drums 2Y through 2BK are open to choice, a yellow, a magenta, a cyan and a black toner image are assumed to be formed on the drums 2Y through 2BK, respectively.

The drums 2Y through 2BK each may be replaced with an image carrier implemented as an endless photoconductive belt passed over a plurality of rollers. The drums 2Y through 2BK each may be made up of a hollow, cylindrical aluminum core having a diameter of 30 mm to 100 mm and a photoconductive, organic semiconductor layer formed on the core.

The drums 2Y through 2BK are held in contact with a first intermediate image transfer body 3, which is implemented as an endless belt in the illustrative embodiment. The intermediate image transfer body (first belt hereinafter) 3 is passed over support rollers or support members 4 and 5 and movable in a direction indicated by an arrow A in FIG. 1. The toner images of different colors formed on the drums 2Y through 2BK are sequentially transferred to the first belt 3 one above the other. The first belt 3 may be replaced with an intermediate image transfer drum, if desired.

The formation of a toner image and the transfer of the toner image to the first belt 3 are identical throughout the drums 2Y through 2BK except for the color of the toner image. The following description will therefore concentrate on the formation of a toner image on the drum 2Y and the transfer of the toner image to the first belt 3 by way of example.

While the drum 2Y is in clockwise rotation, as viewed in FIG. 1, a discharger 7 initializes the surface potential of the drum 2Y with light. A charger 8 uniformly charges the discharged surface of the drum 2Y to preselected polarity, i.e., negative polarity in the illustrative embodiment. An exposing unit 9 scans the charged surface of the drum 2Y with a laser beam L modulated in accordance with image data, thereby forming a latent image. While the charger 8 is implemented as a charge roller in the illustrative embodiment, it may be replaced with, e.g., a corona discharger or a charge blade. Also, the exposing unit 9 emitting the laser beam L may be replaced with an exposing unit using an LED (Light-Emitting Device) array and focusing means.

When the latent image formed on the drum 2Y is conveyed to a developing unit 11, the developing unit 11 develops the latent image with yellow toner to thereby produce a yellow toner image. In the illustrative embodiment, the developing unit 11 includes a developing roller 10 on which a dry developer is deposited. The developing roller 10 conveys the developer so as to develop the latent image therewith.

An image transfer roller 12, which is a specific form of first image transferring means, and a back roller 13 face the drum 2Y with the intermediary of the first belt 3. The image transfer roller 12 and back roller 13 are held in contact with the inner surface of the first belt 3, causing the drum 2Y and belt 3 to form an adequate nip therebetween.

A bias for image transfer opposite in polarity to the toner image formed on the drum 2Y, i.e., a positive bias is applied to the image transfer roller 12, forming an electric field between the drum 2Y and the first belt 3. The electric field causes the toner image to be electrostatically transferred from the drum 2Y to the first belt 3, which is rotated in synchronism with the drum 2Y. In this manner, the first image transferring means transfers the toner image from the drum 2Y to the first belt 3.

After the image transfer from the drum 2Y to the first belt 3, a cleaning unit 14 removes toner left on the drum 2Y with a cleaning member 14A, thereby cleaning the surface of the drum 2Y.

A magenta toner image, a cyan toner image and a black toner image are respectively formed on the drums 2M, 2C and 2BK by respective developing units in exactly the same manner as the yellow toner image formed on the drum 2Y. Image transfer rollers or first image transferring means assigned to the drums 2M through 2BK sequentially transfer the magenta, cyan and black toner images to the first belt 3 over the yellow toner image existing on the belt 3, thereby completing a full-color toner image. This full-color toner image will sometimes be referred to as a first image hereinafter.

A second intermediate image transfer body 15 is positioned at the right-hand side of the first belt 3, as seen in FIG. 1. The second image transfer body 15 is also implemented as an endless belt passed over support rollers 16, 17, 18 and 21 and rotatable in a direction indicated by an arrow in synchronism with the first belt 3. This image transfer body 15 will be referred to as a second belt 15 hereinafter. An image transfer roller 20, which is a specific form of second image transferring means, is positioned between the opposite runs of the second belt 15, i.e., in the loop of the belt 15 in such a manner as to substantially face the support roller 5 supporting the first belt 3. The image transfer roller 20 and support roller 21, which plays the role of a back roller, contact the inner surface of the second belt 15, causing the first belt 3 and image transfer roller 20 to form an adequate nip therebetween.

A bias for image transfer opposite in polarity to the first image carried on the first belt 3, i.e., a positive bias is applied to the image transfer roller 20, forming an electric field between the first belt 3 and the second belt 15. The electric field electrostatically transfers the first image from the first belt 3 to the second belt 15 when the first image is brought to a position between the two belts 3 and 15. In this manner, the second image transferring means transfers the first image from the first belt 3 to the second belt 15.

After the transfer of the first image from the first belt 3 to the second belt 15, a cleaning unit 22 removes toner left on the belt 3 as well as paper dust and other impurities with a cleaning member 22A, thereby cleaning the surface of the first belt 3.

As soon as the second belt 15 in rotation conveys the first image to a preselected position, other toner images of different colors start being formed on the drums 2Y through 2BK in exactly the same manner as the previous toner images. Again, such toner images are sequentially transferred from the drums 2Y through 2BK to the first belt 3 one above the other, completing a full-color image. This full-color image will sometimes be referred to as a second image hereinafter.

A sheet feeding device 23 is positioned in the lower portion of the housing and includes, e.g., two sheet cassettes 24 and 24A and pickup rollers 25 and 25A assigned to the cassettes 24 and 24A, respectively. The sheet cassettes 24 and 24A each are loaded with a stack of paper sheets, resin sheets or similar recording media (sheets P hereinafter). The pickup roller 25 or 25A is held in contact with the top of the sheet stack of the associated sheet cassette 24 or 24A and pays out the top sheet when rotated. The sheet paid out from the sheet cassette 24 or 24A is conveyed toward a registration roller pair 26, which is a specific form of registering means, via a path formed by guide members.

The registration roller pair 26 stops the sheet P and then conveys it at such a timing that the second image on the first belt 3 and the first image on the second belt 15 will be transferred to opposite sides of the sheet P in accurate register. More specifically, the sheet P driven by the registration roller pair 26 is conveyed upward via a position where the first and second belts 3 and 15 contact each other. At this instant, the first image on the second belt 15 is transferred to one side of the sheet P while the second image on the first belt 3 is transferred to the other side of the same sheet P.

The order of transfer of the first and second images to opposite sides of the sheet P is open to choice. The first and second images may be transferred to opposite sides of the sheet P at the same time, if desired. In the illustrative embodiment, the second image on the first belt 3 starts being transferred to the other side of the sheet P, and then the first image on the second belt 15 starts being transferred to the one side of the sheet P.

More specifically, when the sheet P passes the nip between the first and second belts 3 and 15, the bias opposite in polarity to the second image is applied to the image transfer roller 20 in order to transfer the second image from the first belt 3 to the other side of the sheet P. The sheet P carrying the second image thereon is continuously conveyed upward in contact with the second belt 15. At this instant, a bias for image transfer opposite in polarity to the first image on the second belt 15, i.e., a positive bias is applied to a corona discharger 27, which is a specific form of third image transferring means, facing the second belt 15. The resulting electric field formed between the second belt 15 and the sheet P transfers the first image from the second belt 15 to the one side of the sheet P.

The corona discharger 27 is spaced from the surface of the second belt 15 and therefore does not contact the sheet P being conveyed in contact with the second belt 15. This protects the second image on the sheet P from disturbance. The corona discharger 27 may be replaced with any other suitable image transferring means so long as it has the function described above.

Fourth image transferring means is used to transfer the second image from the first belt 3 to the other side of the sheet P. In the illustrative embodiment, the function of the fourth image transferring means is assigned to the image transfer roller or second image transferring means 20. That is, the second image transferring means plays the role of the fourth image transferring means at the same time.

While the second and fourth image transferring means may be constructed independently of each other, a single image transferring device serving as both of such image transferring means is successful to simplify the construction of the printer. Further, if a charger, not shown, is used switch the polarity of the second image on the first belt 3 or the polarity of the first image on the second belt 15, then a single image transferring device can serve as all of the second, third and fourth image transferring means, further simplifying the construction of the printer.

The sheet P carrying the first and second images thereon is released from the second belt 15 and further conveyed upward to fixing means 28. In the illustrative embodiment, the fixing means 28 includes first heating means 29 and second heating means 30 each being implemented as a heat roller. The heat rollers 29 and 30 each are heated by a heat source disposed therein and rotatable in contact with the other heat roller in a direction indicated by an arrow in FIG. 1. The heat rollers 29 and 30 fix the first and second images carried on the sheet P with heat and pressure at the same time. The sheet or print P coming out of the fixing means 29 is driven out of the printer to a tray 31 by an outlet roller pair 60 in a direction indicated by an arrow C in FIG. 1.

The surfaces of the heat rollers 29 and 30 may be coated with silicone rubber or similar material having a high parting ability. The surfaces should preferably be formed of the same material so as to provide the first and second images on the sheet P with the same gloss and tone.

After the transfer of the second image to the sheet P, the cleaning unit 22 cleans the surface of the first belt 3. Also, after the transfer of the first image to the sheet P, a cleaning unit 32 cleans the surface of the second belt 15 with a cleaning member 32E. Toner conveying means, not shown, conveys the removed toner to a waste toner storing section not shown.

While the cleaning member 32E, like the cleaning member 14A or 22A, is implemented as a cleaning blade, it may be replaced with any other suitable cleaning member. The cleaning member 32E is released from the second belt 15 when the first image on the belt 15 passes the cleaning member 32E and then brought into contact with the belt in the event of cleaning.

The second belt 15 may be constructed to be angularly movable about the support roller 16 into and out of contact with the first belt 3. In such a case, the second belt 15 will be brought into contact with the first belt 3 either directly or via the sheet P when the first image is transferred from the belt 3 to the belt 15 or when the second image is transferred from the belt 3 to the sheet P, respectively. The second belt 15 will be released from the first belt 3 in the other conditions.

The illustrative embodiment shown and described has various advantages, as will be described hereinafter. Only if the sheet P is fed to the nip between the first and second belts 3 and 15, full-color images can be transferred to both sides of the sheet P. This reduces a period of time necessary for color images to be formed on both sides of a sheet and thereby enhances productivity. Further, the illustrative embodiment does not have to execute the conventional steps of forming an image on one side of a sheet, turning the sheet and again conveying the sheet to an image carrier, thereby obviating troubles ascribable to conveyance errors. Moreover, because the sheet P does not contact any one of the image carriers 2Y through 2BK, toner images formed on the image carriers are protected from degradation. In addition, the toner images are sequentially transferred from the image carriers 2Y through 2BK to the first belt 3 one above the other, completing a full-color image in a short period of time. This further enhances the productivity of full-color images.

Assume that after the first image transferred to one side of a sheet has been fixed, the second image is transferred to the other side of the sheet and then fixed. Then, when the sheet is passed through fixing means for the first time, it is slightly extended by heat and pressure. As a result, the second image is transferred to the other side of the extended sheet and therefore in a magnification slightly different from the magnification of the first image. By contrast, in the illustrative embodiment, the fixing means 28 fixes the first and second images of the sheet P at the same time to thereby obviate a difference in magnification.

In the illustrative embodiment, the first image is transferred to the second belt 15 while the second image is transferred to the first belt 3. Subsequently, the first and second images are transferred to opposite sides of the sheet P at a time. This protects the images from color deviation for thereby enhancing image quality. Should toner images of different colors formed on a plurality of image carriers be sequentially transferred to a sheet, the toner images might be brought out of register due to unstable sheet conveyance.

The cleaning units 22 and 32 respectively clean the first and second belts 13 and 15 after the transfer of the images to the sheet P, so that the color images on both sides of the sheet P are free from a difference in tone. In addition, the cleaning units 22 and 32 can remove even paper dust from the belts 13 and 15, preventing the color images from being degraded.

The first belt 3 has a resistance that allows the toner images to be transferred from the image carriers and allows the belt 3 to support them. For example, the first belt 3 may be made up of a 50 $\mu$m to 600 $\mu$m thick resin film or a rubber base and a surface layer having low surface energy.

Likewise, the second belt 3 has a resistance that allows the toner image to be transferred from the first belt 3 and allows the belt 15 to support the toner image. For example, the second belt 15 may be made up of a 50 $\mu$m to 600 $\mu$m thick resin film or a rubber base resistant to heat and a parting layer coated on the film or the base and formed of fluorocarbon resin or similar resin having low surface energy. For the resin film, use may be made of polyimide or polyamideimide. The second belt 15 resistant to heat is protected from rapid thermal deterioration even when it is located in the vicinity of the fixing means 28. The circumferential length of the second belt 15 may be great enough to support two images of size A4 at a spacing with the short sides of the images extending in the lengthwise direction of the belt 15, e.g., 548 mm. With such a length, the second belt 15 can support even a single image of size A3 or an image sized slightly greater than A3.

The first and second belts 3 and 15 each have a volume resistivity ranging from $10^5$ Ω.cm to $10^{12}$ Ω.cm, preferably $10^7$ Ω.cm to $10^{11}$ Ω.cm, and a surface resistivity ranging from $10^6$ Ω/cm$^2$ to $10^{13}$ Ω/cm$^2$, preferably $10^8$ Ω/cm$^2$ to $10^{12}$ Ω/cm$^2$. To promote the efficient transfer of the first image from the first belt 3 to the second belt 15, it is preferable to provide the first belt 3 with a higher volume resistivity than the second belt 15 and to provide the first belt 3 with a higher surface resistivity than the second belt 15. Among the members contacting the inner surfaces of the first and second belts 3 and 15, the members other than the transfer rollers 12 and 20 should preferably be connected to ground in order to enhance efficient image transfer and therefore to obviate defective images.

The charger 8, developing unit 11, cleaning unit 14 and so forth arranged around each of the drums 2Y through 2BK may be constructed into a -replaceable process cartridge.

To make both the first image on one side of the sheet P and the second image on the other side of the sheet P non-reversed, it is necessary to form reversed latent images on the drums 2Y through 2BK when forming the first image and then form non-reversed latent images on the same when forming the second image. Such a switching operation is effected by a write controller not shown.

In the illustrative embodiment, the sheet S is driven out of the printer to the tray 31 with its side carrying the second image facing downward. Therefore, to stack the consecutive sheets or prints S on the tray 31 in order of page, toner images should only be formed on the drums 2Y through 2BK such that the first image is the image of the second page while the second image is the image of the first page. This can be done with a conventional technology for storing image data in a memory.

As shown in FIG. 1, a control unit E1 and a power supply unit E2 are disposed in the housing 1. In addition, a fan F1 is located in the vicinity of the fixing means 28 in order to exhaust the inside of the housing 1, thereby preventing the inside of the housing 1 from being overheated.

The transfer rollers 12 and 20 playing the role of the first and second image transferring means, respectively, may be replaced with brushes or brush rollers also contacting the first and second belts 3 and 15 or corona dischargers spaced from the belts 3 and 15. The roller 12 pressing the first belt 3 against the drum and the roller 20 pressing the second belt 15 against the first belt 3 are more advantageous than the other image transferring means as far as effective transfer is concerned.

The first belt 3 and second belt 15, which play the role of intermediate image transfer bodies, each can be passed over the support rollers in a configuration that implements a compact layout. It follows that the entire configuration including the drums 2Y through 2BK arranged side by side is compact, reducing the size of the entire printer.

Figure 2:
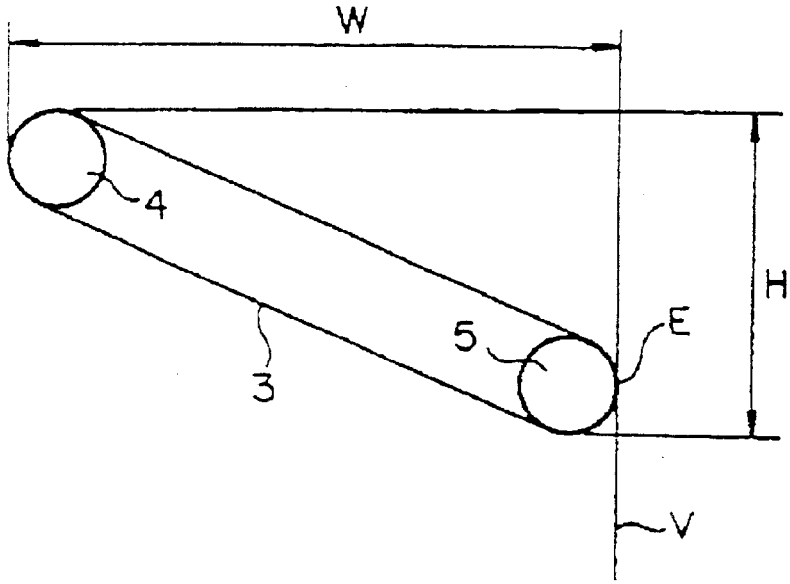
FIG. 2 is a view showing a first intermediate image transfer body included in the illustrative embodiment.

Particularly, as shown in FIG. 2, the first belt 3 has a height H smaller than a width W in the horizontal direction. In addition, the sheet path and the first belt 3 are positioned relative to each other such that the sheet P passes, in the vertical direction, one end E of the first belt 3 disposed in the horizontal direction. It is therefore possible to reduce the height of the first belt 3 for thereby reducing the overall height of the printer. Moreover, because the sheet P passes the end E of the first belt 3, it is possible to reduce the dead space of the housing 1 and to reduce the size of the printer in the horizontal direction, compared to a case wherein a sheet is conveyed in the horizontal direction.

Further, when the drums 2Y through 2BK are arranged along the lower run 3A of the first belt 3, as shown in FIG. 1, or when they are arranged along the upper run 3B, as will be described with reference to FIGS. 14 and 16 later, the drums 2Y through 2BK are well balanced in arrangement. This further reduces the dead space of the housing 1 and makes the printer more compact.

In the illustrative embodiment, the tray 31 is positioned above the first belt 3 and inclined such that its downstream side is higher in level than its upstream side in the direction of sheet discharge, so that a plurality of sheets or prints can be neatly stacked. If the upper run 3B of the first belt 3 is substantially parallel to the tray 31, then it is possible to further reduce the dead space of the housing 1.

In the illustrative embodiment, the sheet feeding device 23 is positioned in the lower portion of the housing 1. The sheet path extends from the sheet feeding device 23 such that the sheet P is conveyed to the image transfer position from below the image transfer position. In addition, the fixing means 28 is positioned above the image transfer position. In this configuration, the sheet P enters the fixing means 28 in a substantially upright position and therefore surely enters the nip between the heat rollers 29 and 30 without bending due to its own weight or abutting against the roller 29 or 30. This prevents the toner images on the sheet P from being disturbed by vibration before fixation and thereby insures high-quality color images. Further, because the fixing means 28 is positioned above the image transfer position, heat generated by the fixing means 28 is successfully discharged by the fan F1 and does not heat the inside of the housing 1 to an excessive degree.

Moreover, in the illustrative embodiment, the portion 15A of the second belt 15 below the image transfer position is so positioned as to be set back from a vertical line V (see FIG. 2) passing through the image transfer position away from the registration roller pair 26. This guarantees a space to be allocated to the registration roller pair 26 and thereby allows the registration roller pair 26 to be freely laid out.

Figure 4:
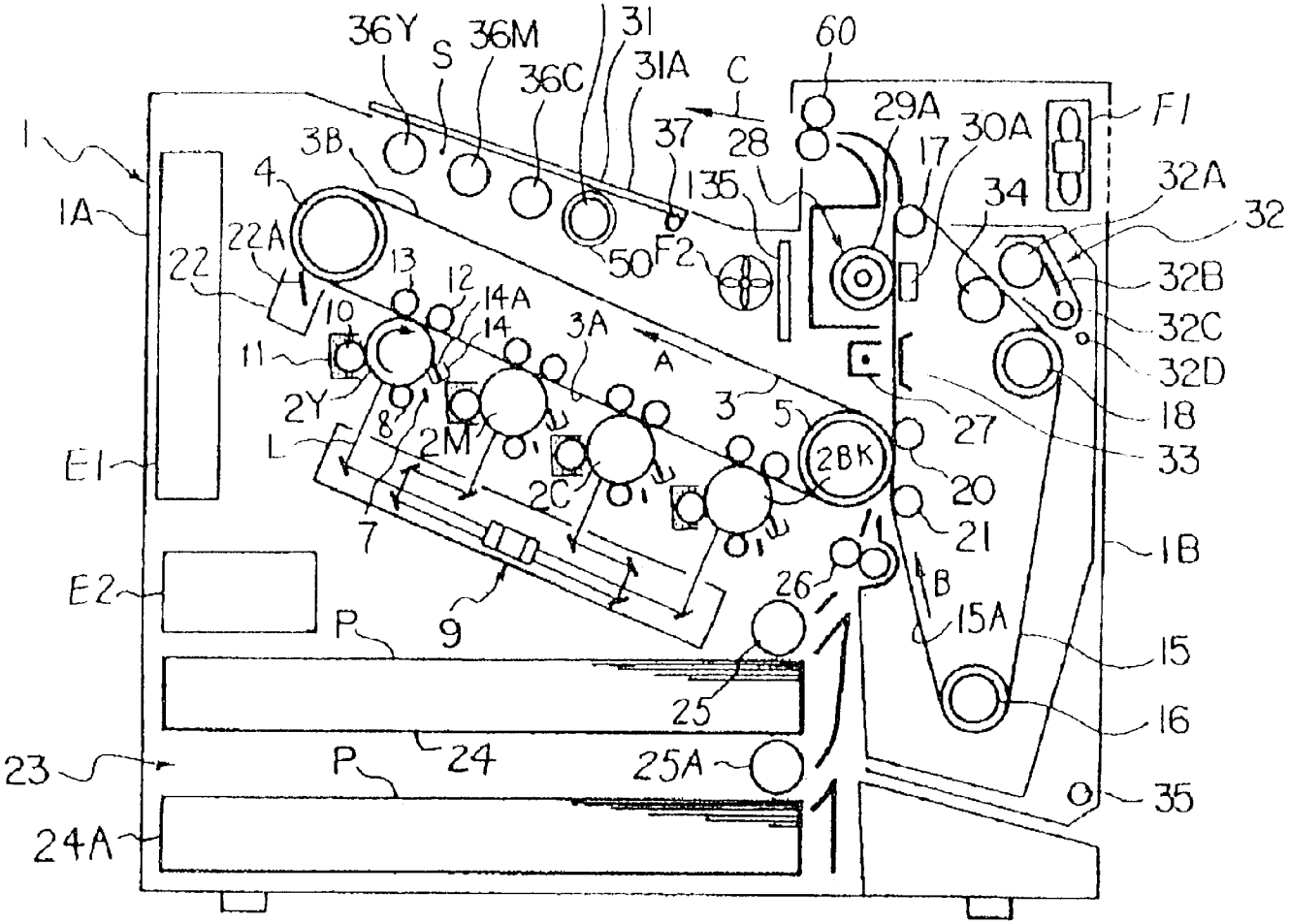
FIG. 4 is a vertical section showing a second embodiment of the present invention.

Reference will be made to FIG. 4 for describing a second embodiment of the image forming apparatus in accordance with the present invention. As for the basic construction, this embodiment is similar to the first embodiment shown in FIG. 1, so that the following description will concentrate on arrangements unique to this embodiment. As shown, the printer includes a back plate 33 and a back roller 34 contacting the inner surface of the second belt 15, which is passed over the support rollers 16, 17, 18 and 21. The back plate 33 faces the corona discharger or third image transferring means 27 with the intermediary of the second belt 15. The cleaning unit 32 includes a cleaning roller or cleaning member 32A facing the backup roller 34. The cleaning unit 32 additionally includes a blade 32B pressed against the cleaning roller 32A and toner conveying means 32C. The cleaning roller 32A is angularly movable about a fulcrum 32D.

The fixing means 28 includes first heating means 29A facing the outer surface of the second belt 15 and second heating means 30A contacting the inner surface of the second belt 15 while facing the first heating means 29A. The first heating means 29A is implemented as a heat roller accommodating a heater therein although it may be replaced with a belt heated by a heater. The second heating means 29A may be implemented as an array of heat generating elements by way of example.

The support roller 16 supporting the second belt 15 plays the role of cooling means for cooling off the belt 15 at the same time. More specifically, the support roller 16 is implemented by a heat pipe storing a coolant thereinside. Alternatively, use may be made of a cooling device that blows cool air against the second belt 15, if desired.

The second belt 15 is identical with the second belt 15 of the first embodiment and has a parting layer formed on a heat-resistant base.

In operation, the first image is transferred from the first belt 3 to the second belt 15 in exactly the same manner as in the first embodiment. Before the first image on the second belt 15 passes the fixing means 28 and cleaning unit 29, the first heating means 29A and cleaning roller 32A are released from the belt 15 so as not to effect the first image. In addition, the first and second heating means 29A and 30A are maintained inoperative.

Subsequently, the first image on the second belt 15 and the second image transferred to the first belt 3 are respectively transferred to one side and the other side of the sheet P in exactly the same manner as in the first embodiment. When the sheet S is brought to the fixing means 28, the first heating means 29A and second heating means 30A are heated. In addition, the first heating means 29A rotates in contact with the other side of the sheet P. In this condition, the first and second images are fixed on the sheet P by heat and pressure at the same time.

The sheet or print P coming out of the fixing means 28 is driven out to the tray 31 in the same manner as in the first embodiment. After the image transfer, the cleaning roller 32A contacting the second belt 15 removes toner left on the belt 15 as well as paper dust and other impurities. The blade 32B scrapes off the toner collected by the cleaning roller 32A. The toner conveying means 32C conveys the toner scraped off to the outside of the cleaning unit 32. Subsequently, the support roller 16 cools off the portion of the second belt 15 cleaned by the cleaning unit 32.

As for the rest of the construction, the illustrative embodiment is identical with the first embodiment. Identical structural elements are designated by identical reference numerals and will not be described specifically in order to avoid redundancy.

In the illustrative embodiment, the heating means 30A of the fixing means 28 faces the inner surface of the second belt 15 and fixes the image on the sheet P being conveyed by the belt 15. The fixing means 28 therefore does not exert any impact on the sheet S as in the previous embodiment. Because the second belt 15 does not contact the drums 2Y through 2BK, the drums 2Y through 2BK are free from the influence of heat generated by the fixing means 28 and are therefore free from thermal deterioration.

The second belt 15, which is resistant to heat and has a high parting ability, is protected from rapid thermal deterioration. In addition, during fixation, the melted toner is prevented from being transferred to the second belt 15.

Further, the cooling means is positioned downstream of the fixing means 28 in the direction of movement of the second belt 15, but upstream of the image transfer position, for cooling off the belt 15. The cooling means therefore cools off the second belt 15 heated during fixation for thereby freeing the transfer of the next image to the belt 15 from the influence of heat.

Figure 3:
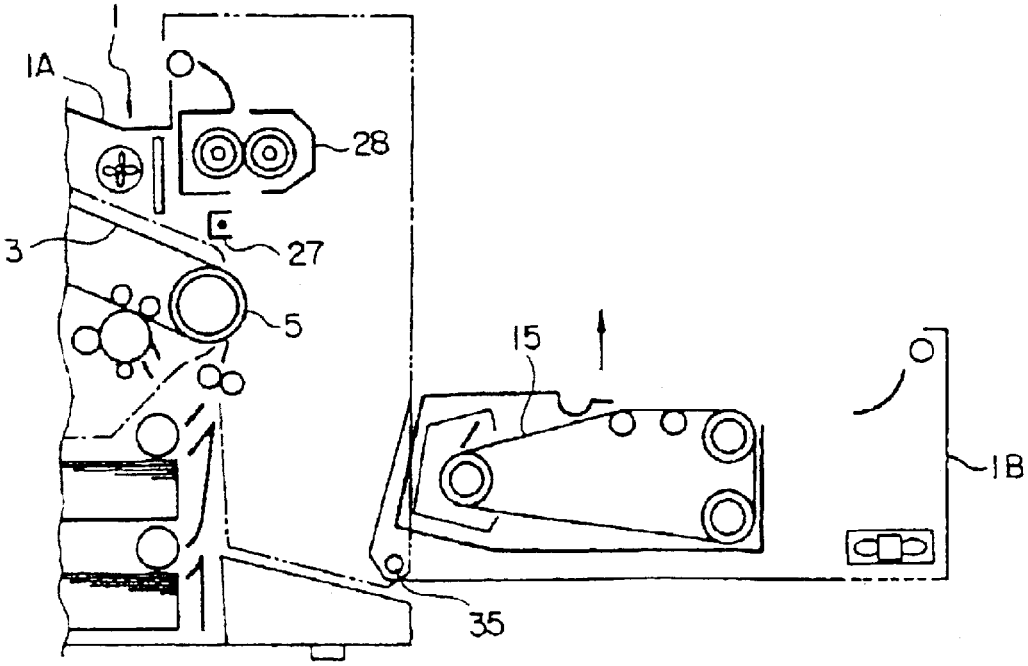
FIG. 3 is a fragmentary section showing a movable housing included in the illustrative embodiment in an open position.
Figure 5:
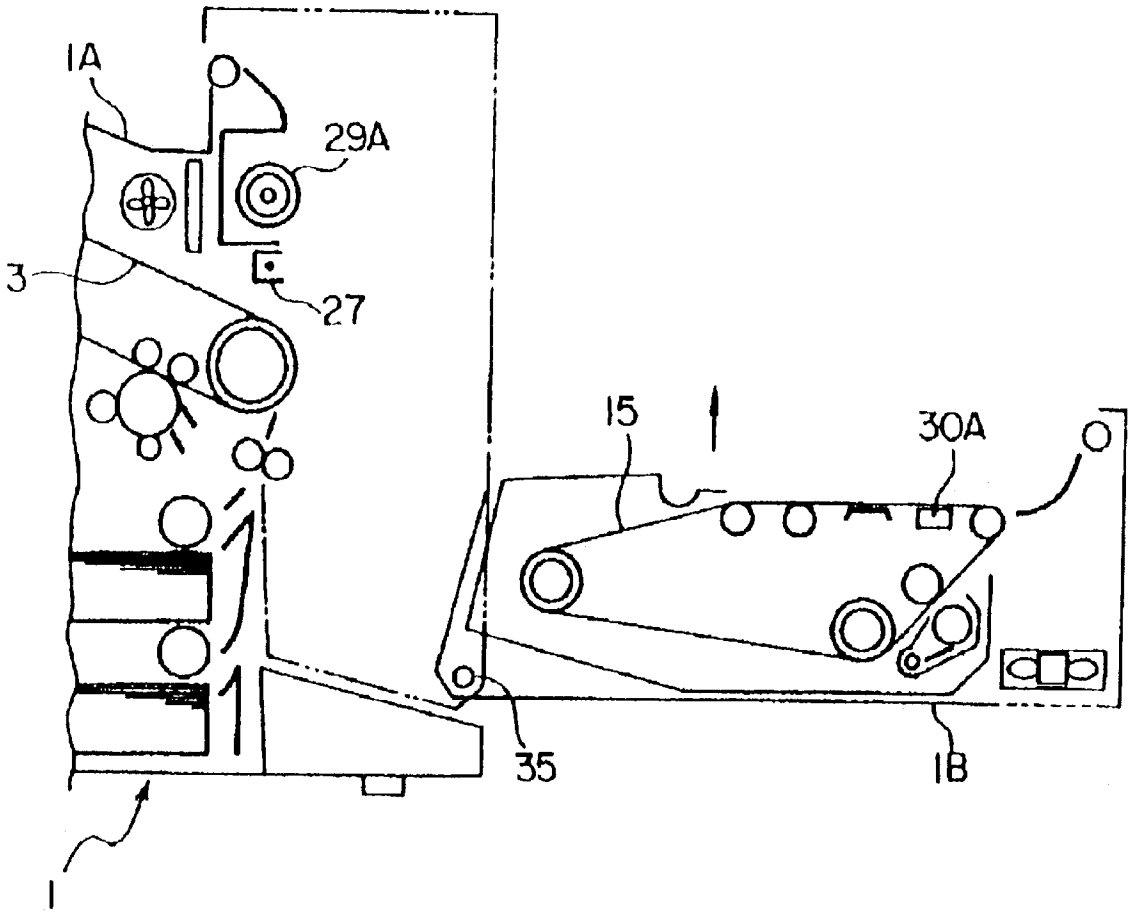
FIG. 5 is a fragmentary section showing a movable housing included in the second embodiment in an open position.

In the first and second embodiments shown in FIGS. 1 and 4, respectively, the housing 1 is made up of a stationary housing 1A and a movable housing 1B supported by the stationary housing 1A via a shaft in such a manner as to be openable. FIGS. 3 and 5 respectively show the movable housing 1B of FIG. 1 and that of FIG. 4 in an open position. As shown, when the movable housing 1B is opened, the sheet path is easily accessible when a sheet jamming the sheet path should be removed. Further, the corona discharger or third image transferring means 27 is mounted on the stationary housing 1A and is exposed to the outside when the movable housing 1B is opened. The operator can therefore easily clean or otherwise maintain the corona discharger 27.

If desired, an arrangement may be made such that the movable housing 1B does not angularly move, but moves toward or away from the stationary housing 1A in an upright position via guide rails or a link mechanism not shown.

In the configuration shown in FIGS. 4 and 5, the first and second heating means 29A and 30A of the heating means 28 are respectively mounted on the stationary housing 1A and movable housing 1B. Therefore, when the movable housing 1B is opened, the two heating means 29A and 30A are moved away from each other. Further, the first and second belts 3 and 15 are respectively mounted on the stationary housing 1A and movable housing 1B such that the belts 3 and 15 move away from each other when the movable housing 1B is opened. This is also true with the configuration shown in FIGS. 1 and 3. In the configuration of FIG. 1, too, the first and second heating means 29 and 30 may be respectively mounted on the stationary housing 1A and movable housing 1B such that they move away from each other when the movable housing 1B is opened.

As stated above, by opening the movable housing 1B, the operator can easily remove a jamming sheet and can easily clean or otherwise maintain the first and second heating means, which are moved away from each other. If desired, the second belt 15 on the movable housing 1B and parts associated therewith may be constructed into a unit, so that the operator can remove the unit upward by opening the movable housing 1B, as shown in FIG. 3 or 5.

Figure 6:
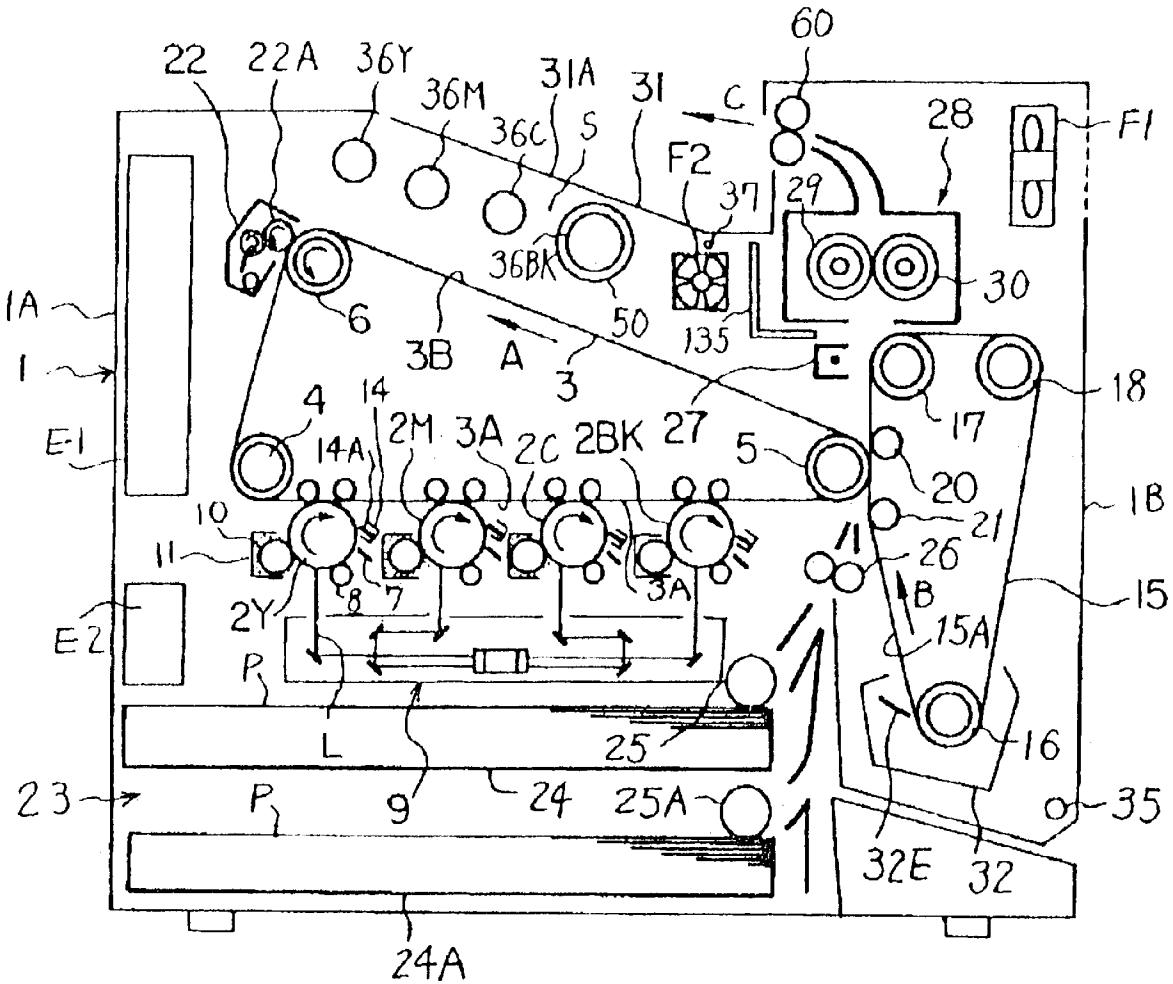
FIG. 6 is a vertical section showing a third embodiment of the present invention.
Figure 7:
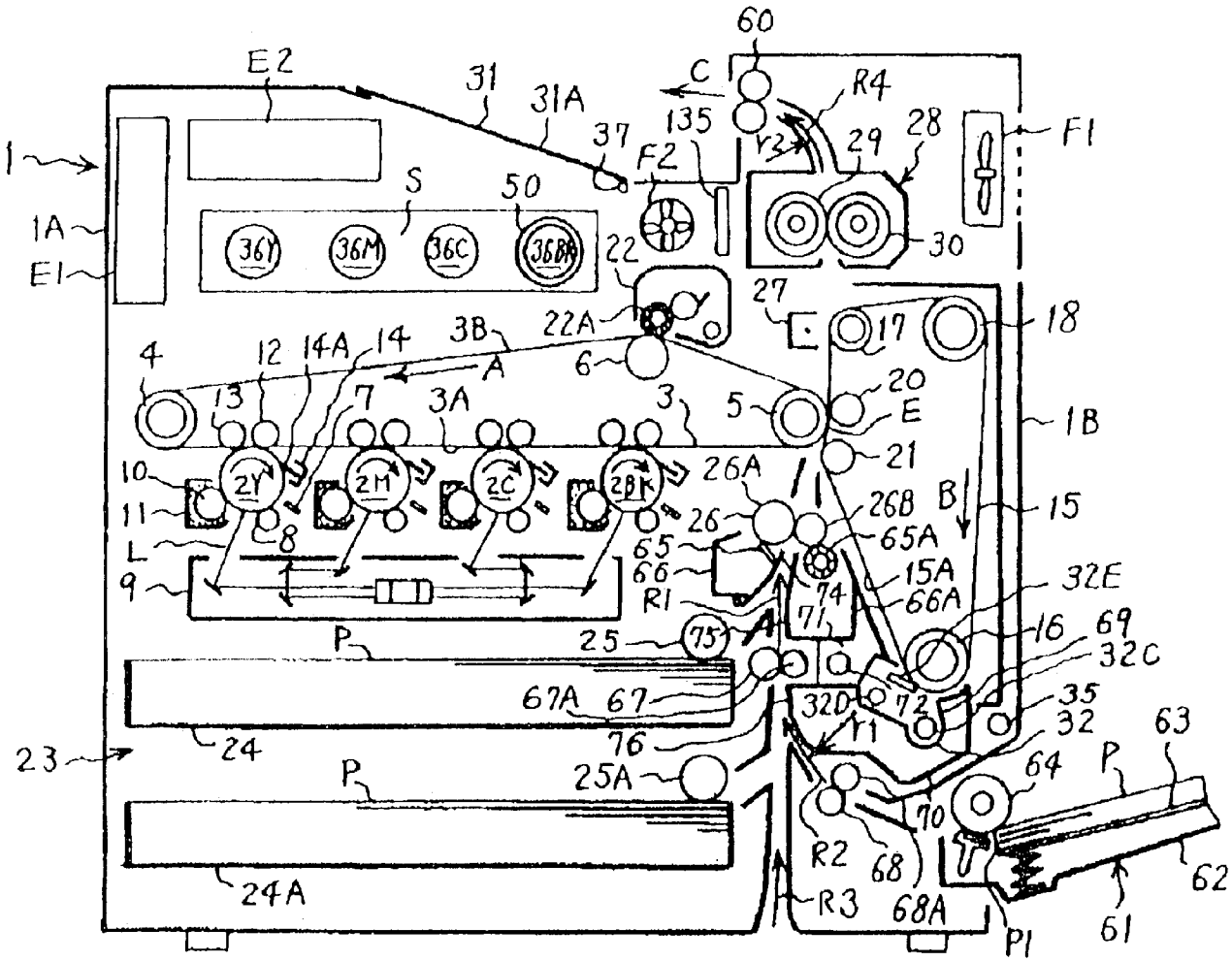
FIG. 7 is a vertical section showing a fourth embodiment of the present invention.

FIGS. 6 and 7 show a third and a fourth embodiment of the present invention, respectively. As shown, the first belt 3 is passed over the support rollers 4, 5 and 6 with its lower run 3A extending in the horizontal direction. The drums 2Y through 2BK are arranged along the horizontal lower run 3A of the first belt 3. The first belt 3 is movable in a direction indicated by an arrow A. The cleaning unit 22 assigned to the first belt 3 has the cleaning member 22A implemented as a cleaning roller. As for basic configuration, the third embodiment of FIG. 6 is identical with the embodiments of FIGS. 1 through 5. In FIG. 6, structural elements identical with the structural elements shown in FIG. 1 are designated by identical reference numerals and will not be described specifically in order to avoid redundancy. This is also true with the embodiment of FIG. 7.

Figure 8:
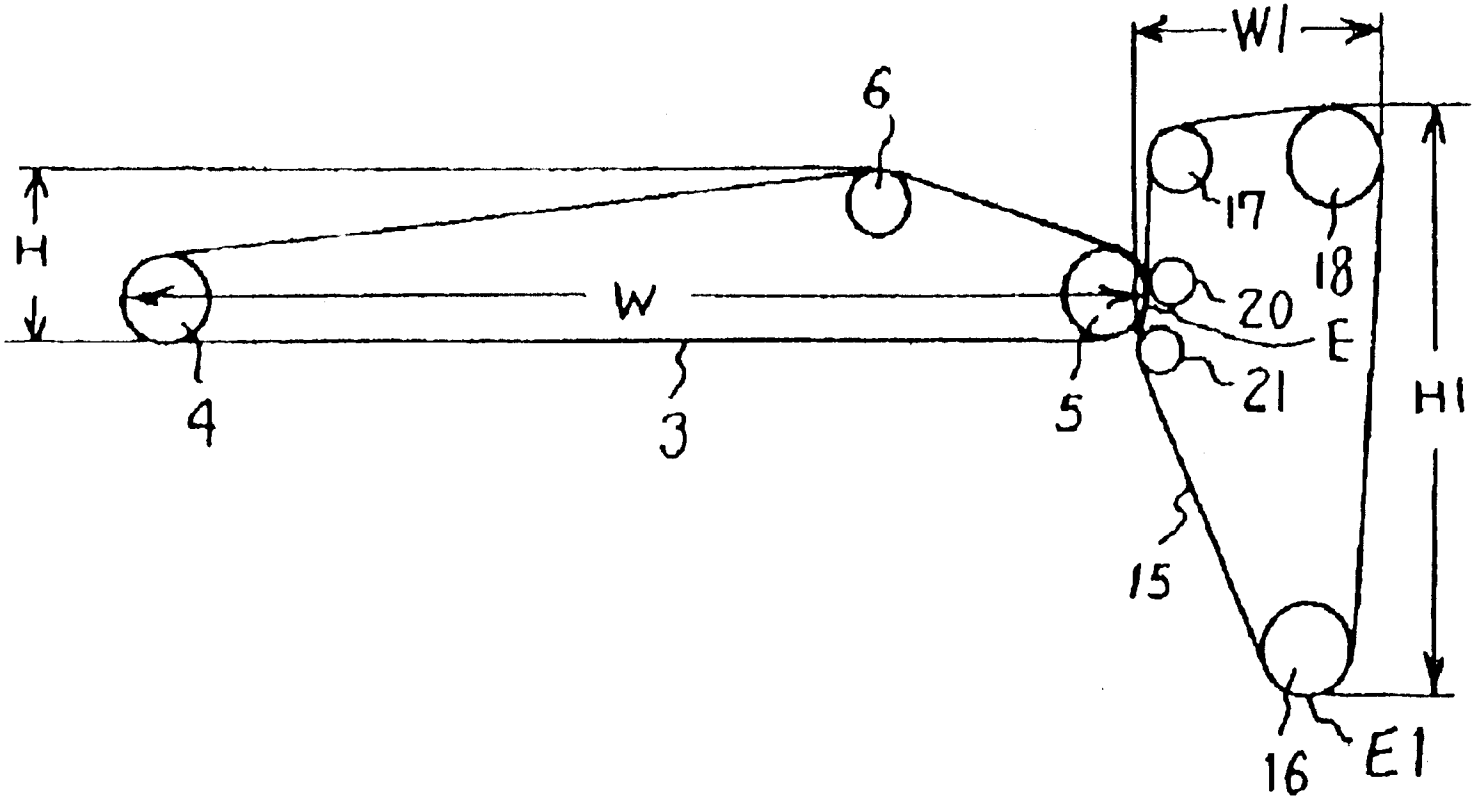
FIG. 8 is a view showing a first and a second intermediate image transfer body included in the fourth embodiment.

In the embodiment shown in FIG. 7, as in the previous embodiments, the first and second belts 3 and 15 each are passed over a plurality of support members. As shown in FIG. 8, the first belt 3 has a height H smaller than a width W in the horizontal direction. The second belt 15 has a height H1 greater than a width W1 in the horizontal direction. The sheet path and first belt 3 are positioned relative to each other such that the sheet P passes one end E of the first belt 3 in the horizontal direction. The registration roller pair 26 lies in a range between the image transfer position and the lower end E1 (see FIG. 8) of the second belt 15 in the direction of height. The illustrative embodiment includes a second sheet feeding device 61 in addition to the sheet feeding device 23. The second sheet feeding device 61 is positioned below the second belt 15 and made up of a frame 62 and a bottom plate 63 supported by the frame 62. Sheets P are stacked on the bottom plate 63. When a pickup roller 64 contacting the top of the sheet stack P is rotated, it pays out the top sheet P toward the registration roller pair 26 via a sheet path indicated by an arrow R2. The sheet P fed from the first sheet feeding device 23 is conveyed toward the registration roller pair 26 via a sheet path indicated by an arrow R1.

Further, the second sheet feeding device 61 is positioned such that the leading edge P1 of the sheet P paid out from the device 61 lies in a range below the second belt 15 in the direction of height. The second sheet feeding device 61 protrudes to the outside of the housing 1. The pickup roller 64 substantially faces the pickup roller 25A of the first sheet feeding device 23.

The exposing unit 9 is positioned below the first belt 3 for forming latent images on the drums 2Y through 2BK.

As stated above, the second belt 15 is elongate in the up-and-down direction and prevents the housing 1 from being increased in size in the horizontal direction. Further, the horizontally extending first belt 3, registration roller pair 26, first sheet feeding device 23 and exposing device 9 are arranged in the space available at one side of the second belt 15. The space inside the housing 1 can therefore be effectively used and accommodates the above structural elements in a compact configuration. Moreover, the second sheet feeding device 61 protrudes to the outside of the housing 1 and therefore does not occupy a large space in the housing 1. These arrangements in combination prevent the casing 1 from being increased in size.

The second sheet feeding device 61 may be configured to be angularly movable about its lower edge relative to the housing 1, if desired. In such a case, the sheet feeding device 61 will be turned clockwise from the position shown in FIG. 7 in such a manner as to be folded up when it is not used, so that the sheet feeding device 61 will not constitute an obstruction.

Figure 9:
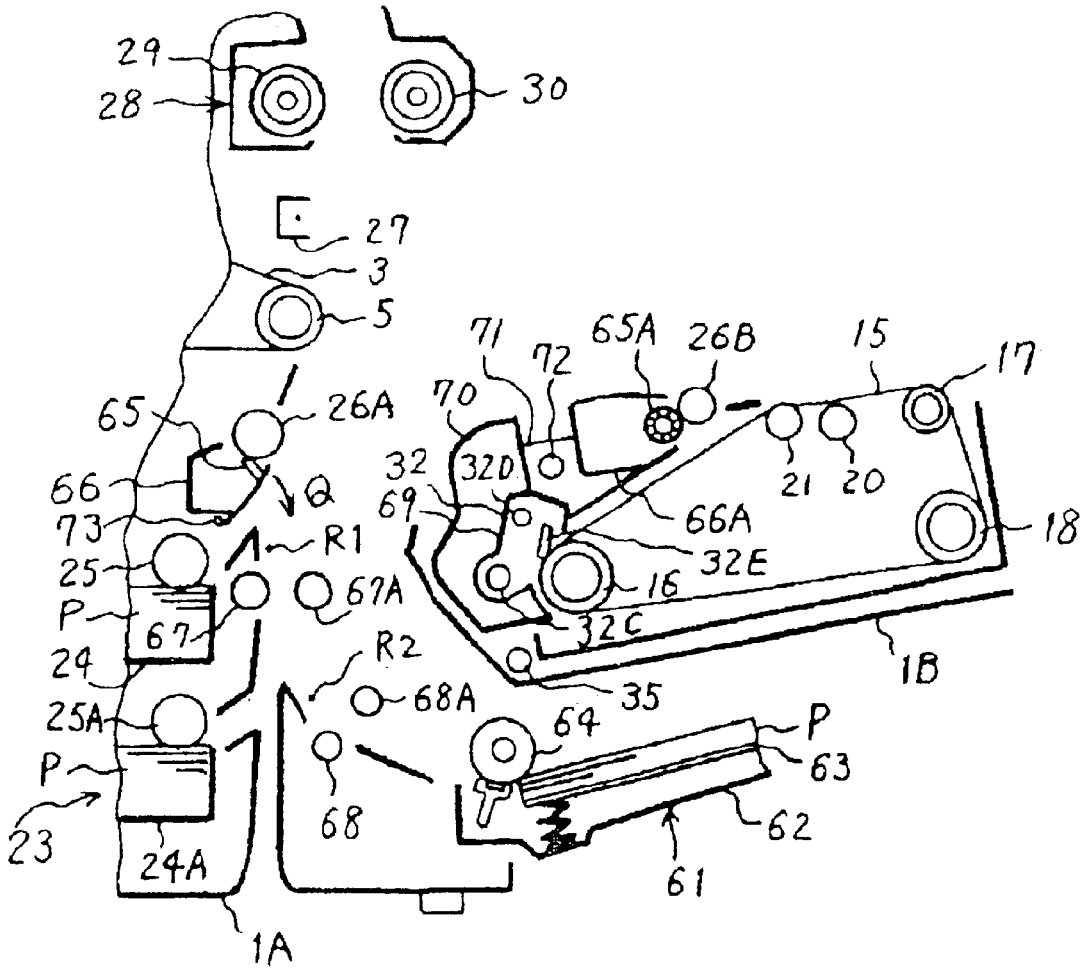
FIG. 9 is a section showing a movable housing included in the fourth embodiment in an open position.

In the embodiment shown in FIG. 7, too, the housing 1 is made up of the stationary housing 1A and movable housing 1B. As shown in FIG. 9, the movable housing 1B is angularly movable about the shaft 35 to an open position. Let the sheet path extending from the first sheet feeding device 23 to the registration roller pair 26 be referred to as a first sheet path R1. Also, the sheet path extending from the second sheet feeding device 61 to the sheet path R1 be referred to as a second sheet path R2. As shown in FIG. 9, the movable housing 1B is positioned relative to the first and second sheet paths R1 and R2 such that when the movable housing 1B is opened, the first and second sheet paths R1 and R2 both are exposed to the outside. Therefore, even when the sheet P jams either one of the first and second sheet paths R1 and R2, the operator can easily remove the sheet P by opening the movable housing 1B.

The embodiment of FIG. 7 additionally includes a third sheet path R3 communicated to the first sheet path R1. When an additional sheet feeding device, not shown, is positioned below the housing 1, a sheet fed from the sheet feeding device is conveyed to the first sheet path R1 via the third sheet path R3.

Let registration rollers constituting the registration roller pair 26 be referred to as a first and a second registration roller 26A and 26B, respectively. First and second impurity removing means 65 and 65A clean the surfaces of the first and second registration rollers 26A and 26B, respectively. A first and a second impurity storing member 66 and 66A store impurities removed by the impurity removing means 65 and 65A, respectively. In the embodiment shown in FIG. 7, the surface of the first registration roller 26A and that of the second registration roller 26B are formed of metal and rubber, respectively. The first impurity removing means 65 is implemented by a blade contacting the first registration roller 26A while the second impurity removing means 65A is implemented by a brush roller contacting the second registration roller 26A.

More specifically, impurities including paper dust and sizing agent deposit on the sheet and effects the surface property or the diameter of the registration rollers 26A and 26B when transferred to and accumulated on them, bringing about sheet conveyance errors. Further, when such impurities are transferred to the image carriers via the first belt 3, they are apt to degrade image quality. The first and second impurity removing means 65 and 65A remove the impurities from the surfaces of the first and second registration rollers 26A and 26B, respectively, thereby solving the above problem. In addition, the removed impurities are collected in the first and second impurity storing members 66 and 66A and therefore prevented from being scattered around.

The first and second registration rollers 26A and 26B are mounted on the stationary and movable housings 1A and 1B, respectively. The first and second impurity storing members 66 and 66A are positioned at opposite sides with respect to the first sheet path R1. Further, the first impurity removing means 65 and first impurity storing means 66 are mounted on the stationary housing 1A while the second impurity removing means 65A and second impurity removing means 66A are mounted on the movable housing 1B. Therefore, when the operator opens the movable housing 1B, as shown in FIG. 9, the first and second registration rollers 26A and 26B are widely spaced from each other, and so are done the first impurity removing means 65 and first impurity storing member 6 and the second impurity removing means 65A and second impurity storing member 66A. This allows the operator to easily remove a jamming sheet. In addition, the impurity removing members 66 and 66A both are exposed to the outside, allowing the operator to remove the impurities collected.

In the embodiment shown in FIG. 7, a pair of rollers 67 and 67A convey the sheet P on the first sheet path R1 while a pair of rollers 68 and 68A convey it on the sheet path R2. These rollers all are mounted on the stationary housing 1A. When the operator opens the movable housing 1B to the position shown in FIG. 9, the rollers 67A and 68B are spaced from the rollers 67 and 68 mounted on the stationary housing 1A. Also, the fixing means 28 is mounted on the stationary body 1A, so that the second heating means 30 is spaced from the first heating means 29 when the operator opens the movable housing 1B. This allows the operator to easily remove the sheet P jamming the fixing means 28. When the operator closes the movable housing 1B to the position shown in FIG. 7, the rollers 67 and 67A, rollers 68 and 68A and heating means 29 and 30 are respectively brought into contact with each other.

Alternatively, the first heating means 29 and rollers 67 and 68 may be mounted on the stationary housing 1A while the second heating means 30 and rollers 67A and 68A may be mounted on the movable housing 1B. In such a case, when the operator opens the movable housing 1B, the rollers 67 and 67A, rollers 68 and 68 and heating means 29 and 30 will also be widely spaced from each other.

The registration rollers 26A and 26B should preferably be long enough to contact the sheet P over the entire length of the sheet P, so that the impurity removing means 65 and 65A can remove impurities deposited on the sheet P by way of the rollers 26A and 26B. This prevents impurities from depositing on the drums 2Y through 2BK or entering images to thereby insure high image quality. If desired, a bias may be applied to each of the registration rollers 26A and 26B in order to electrostatically remove impurities.

In the embodiment of FIG. 7, the cleaning unit 32 assigned to the second belt 15 includes toner conveying means 32C in addition to the cleaning blade or cleaning member 32E. The toner conveying means 32C conveys toner removed from the belt 15 by the cleaning blade 32E and dropped into a cleaning case 69 in a direction perpendicular to the sheet surface of FIG. 7. The cleaning unit 32 is angularly movable about a fulcrum 32D.

The toner removed from the second belt 15 by the cleaning unit 32 is collected in a waste toner storing member 70. The waste toner storing member 70 and cleaning unit 32 are mounted on the movable housing 1B with the member 70 adjoining a second impurity storing member 66A. Therefore, by opening the movable housing 1B, the operator can easily discard toner collected in the waste toner storing member 70 and impurities collected in the second impurity storing member 66A. Further, the cleaning unit 32 and waste toner storing member 70 are located independently of each other, allowing toner to be hermetically confined in the storing member 70. This prevents toner from leaking from the waste toner storing member 70 when the movable housing 1B is opened.

An arrangement should preferably be made such that when the movable housing 1B is opened, at least one of the waste toner storing member 70 and second impurity storing member 66A can be dismounted from the movable housing 1B. Such an arrangement allows toner and impurities to be easily be taken out or allows the waste toner storing member 70 and second impurity storing member 66A to be easily replaced with new ones.

The waste toner storing member 70 and second impurity storing member 66A may be constructed integrally with each other so as to be removed from the movable housing 1B together. This further facilitates the discard of waste toner and impurities or the replacement of the two members 70 and 66A. More specifically, the waste toner storing member 70 and second impurity storing member 66A are connected together by a connecting member 71. At this instant, a grip 72 implemented as a recess or a hole should preferably be formed in the connecting member 71, so that the operator can more easily handle the storing members 70 and 66A by holding the grip 72.

When the movable housing 1 is in a closed position, the roller 67A adjoins the connecting member 71. However, because the roller 67A is not mounted on the movable housing 1B, but mounted on the stationary housing 1A, the roller 67A is widely spaced apart from the connecting member 71 when the movable housing 1B is opened to the position shown in FIG. 9. In this condition, the operator can hold the grip 72 without being obstructed by the roller 67A.

The waste toner storing member 70 and second impurity storing member 66A may be arranged in the space surrounded by the first sheet path R1, second sheet path R2, and second belt 15. This effectively uses the limited space available in the housing 1 for thereby preventing the housing 1 from being increased in size.

Further, an arrangement may be made such that by opening the movable housing 1B, the operator can remove the first impurity storing member 66 from the stationary housing 1A for discarding impurities collected therein or replacing it with a new, empty impurity storing member 66. At this instant, as shown in FIG. 9, it is preferable to cause the stationary housing 1A to rotatably support the first impurity storing member 66 via a pin 73. In such a case, the operator can easily remove the first impurity storing member 66 by rotating the storing member 66 in a direction Q by holding a grip, not shown, and then removing the storing member 66 from the stationary housing 1A.

The first and second sheet paths R1 and R2 each are formed by a number of guide members. The first and second impurity storing members 66 and 66A and waste toner storing member 70 may constitute guides in order to reduce the number of exclusive guides for thereby reducing the cost of the printer. For example, the impurity storing members 66 and 66A and waste toner storing member 70 are implemented as resin moldings including guide surfaces 74, 75 and 75, respectively, that face the sheet paths R1 and R2. Ribs should preferably be positioned on the guide surfaces 74 through 76 because resistance increases if the sheet P contacts the entire guide surfaces 74 through 76.

The second sheet feeding device 61, FIG. 7, is used to feed thick sheets, envelopes and other special sheets that are apt to jam the sheet paths by hand. In this case, it is necessary to reduce resistance to act on the sheet P being conveyed along the second sheet path R2, thereby obviating sheet jams. For this purpose, guide members forming the second sheet path R2 are so configured as to provide the sheet path R2 with a radius of curvature r1 of 40 mm or above. The sheet path R2 with this configuration can smoothly guide even a thick sheet or similar special sheet from the second sheet feeding device 61 to the registration roller pair 26 without causing it to be switched back. The second sheet feeding device 61 can therefore convey, e.g., a 200 kg sheet of size A4 without any trouble or can convey an envelope, which is a laminate of sheets, without any crease. For the same reason, a sheet path R4 extending from the fixing means 28 to the outlet roller pair 60 may be provided with a radius of curvature r2 of 40 mm or above.

As for the rest of the construction, the printer shown in FIGS. 7 through 9 may be identical with the printers shown in FIGS. 1 through 6.

In the illustrative embodiments described above, when any one of the developing units 11 respectively assigned to the drums 2Y through 2BK becomes short of toner, it is necessary to replenish fresh toner to the developing unit. For this purpose, in the first to fourth embodiments shown in FIGS. 1, 4, 6 and 7, respectively, toner containers 36Y, 36M, 36C and 36BK each are associated with one of the developing units 11. The toner containers 36Y, 36M, 36C and 36BK store yellow toner, magenta toner, cyan toner and black toner, respectively. When any one of the developing units 11 becomes short of toner, a powder pump, not shown, is operated to replenish fresh toner from the corresponding toner container to the developing unit.

As shown in FIGS. 1, 4, 6 and 7, the toner containers 36Y through 36BK are accommodated in a space S between the tray 31 and the first belt 3. The entire tray 31 or part thereof is implemented as a cover 31A angularly movable about a fulcrum 37 relative to the housing 1. The cover 31A is usually held in a closed position so as to stack sheets or prints P thereon.

Figure 10:
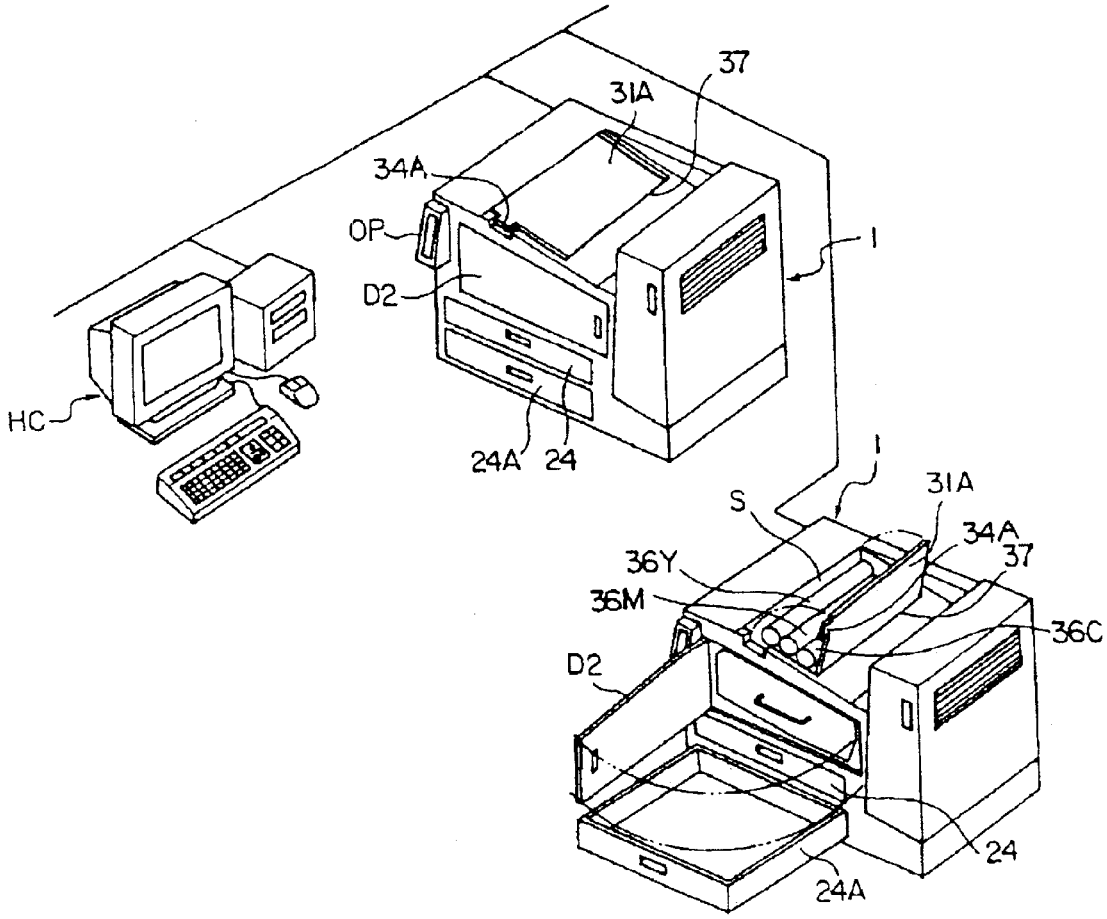
FIG. 10 is an isometric view showing a specific image forming system available with the present invention.

FIG. 10 shows two printers each having the configuration shown in any one of FIGS. 1, 4, 6 and 7. As shown, the cover 31A of the printer in the upper portion of FIG. 10 is held in a closed position and provided with a grip 34A. By holding the grip 34A, the operator can move the cover 31A to an open position as represented by the cover 31A of the printer shown in the lower portion of FIG. 10. In the open position of the cover 31A, the operator can easily mount or dismount the toner containers 36Y through 36BK to or from the space S.

The fulcrum 37 is positioned at the lower end of the tray 31. Therefore, even when the cover 31A is opened with prints P existing on the tray 31, the prints P are prevented from dropping or from being disturbed as to the order of page. In addition, the grip 34A is configured and positioned such that it does not obstruct the conveyance or the stacking of the prints P on the tray 31.

Figure 11:
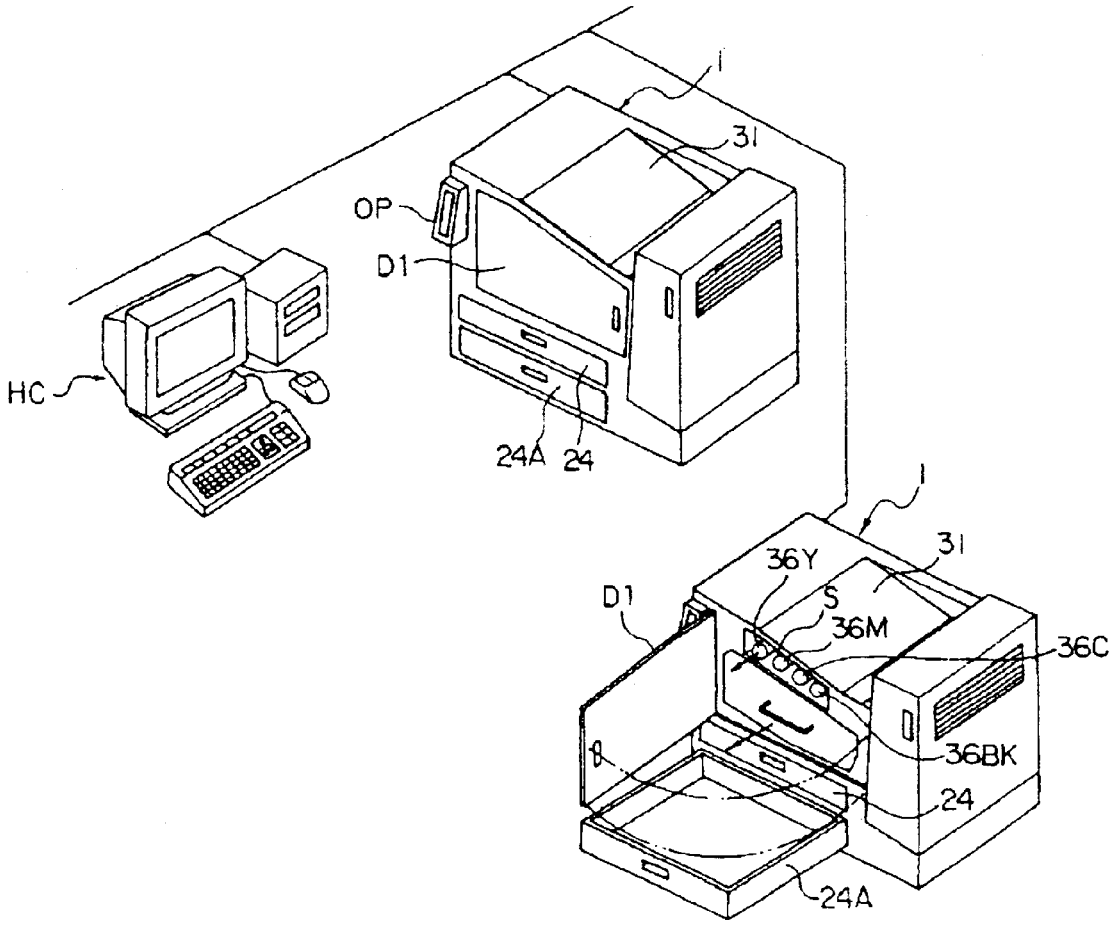
FIG. 11 is a view similar to FIG. 10, showing another specific image forming system.

As shown in FIG. 11, a door D1 may be mounted on the housing 1 in place of or in addition to the cover 31A, FIG. 10. The door D1 is positioned below the tray 31 and angularly movable to uncover the space S. More specifically, the door D1 is usually closed as shown in the upper portion of FIG. 11 or is opened to uncover the space S for facilitating the mounting or the dismounting of the toner containers 36Y through 36B. The door D1 allows the toner containers 36Y through 36BK to be easily replaced even when a writing unit, which will be described later, is positioned above the tray 31.

As shown in FIGS. 10 and 11, the sheet cassettes 24 and 24A are mounted on the housing 1 such that they can be pulled out by hand, as needed. Even when the door D1 is opened, it does not obstruct the pull-out of the sheet cassettes 24 and 24A or the manipulation of an operation panel OP.

The printer shown in FIG. 10 also includes a door D2 mounted on the housing 1. By opening the door D2 or D1, the operator can pull out the drums 2Y through 2BK, first belt 3 and structural elements around them toward the operator while leaving the exposing unit 9 in the housing 1 and then dismount the drums and first belt. If desired, such structural elements may be mounted on a single base slidable on guide rails, so that the operator can pull them together toward the operator. Because the door D1 or D2 is hinged to the housing 1, it does not hide parts to be maintained positioned below the door D1 or D2 or the operation panel OP.

It is likely that much heat output from the fixing means 28 is transferred to the toner of the toner containers 36Y through 36BK set in the space S, causing the toner to melt. In light of this, protecting means for protecting the toner from heat should preferably be provided. A heat insulating member 135 shown in FIGS. 1, 4, 6 and 7 and intervening between the space S and the fixing means 28 is a specific form of such protecting means. The heat insulating member 135 prevents heat output from the fixing means 28 from being directly transferred to the toner containers 36Y through 36BK. For the heat insulating member 135, use may be made of a resin plate with or without a brush implanted therein or a stack of resin plates spaced from each other by air layers.

A fan F2 shown in FIGS. 1, 4, 6 and 7 is another specific form of the protecting means. The fan F2 sucks outside air and causes it to flow between the space S and the fixing means 28 for thereby preventing the heat of the fixing means 28 from being directly transferred to the space S. A duct, not shown, for discharging sucked air to the outside of the housing 1 maybe additionally provided, if desired.

A cover 50 shown in FIGS. 1, 4, 6 and 7 is still another specific form of the protecting means and configured to surround at least one of the toner containers 36Y through 36BK, i.e., the toner container 36BK closest to the fixing means 28.

Figure 13:
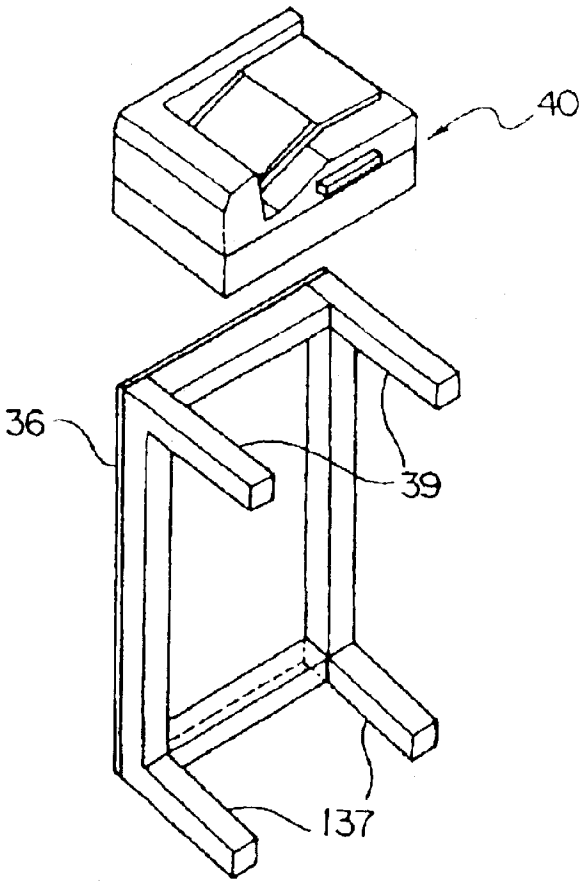
FIG. 13 is a perspective view of a stand included in the configuration of FIG. 12.
Figure 12:
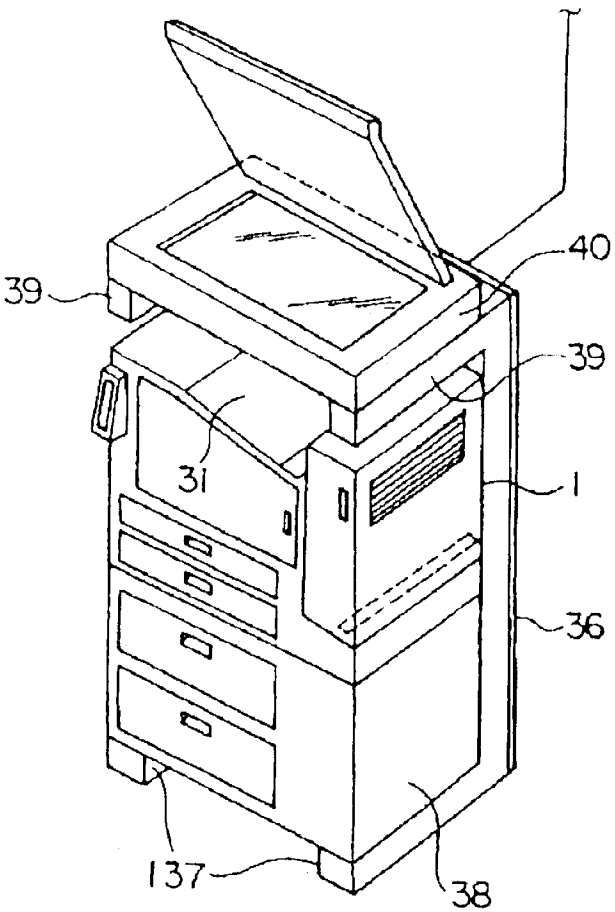
FIG. 12 is an isometric view showing a specific configuration of the image forming apparatus of the present invention additionally including a scanner.

FIG. 12 shows a specific configuration of the image forming apparatus in which the housing 1 of any one of the illustrative embodiments is set on a sheet bank 38, which is capable of storing a large number of sheets. More specifically, FIG. 13 shows a stand 36 including lower support portions 137 and upper support portions 39. The sheet bank 38 is mounted on the lower support portions 137. Further, a scanner 40 is mounted on the upper support portions 39. The scanner 40 is therefore positioned above and spaced from the housing 1, i.e., the tray 31. This kind of configuration allows an additional function, e.g., a copier function or a facsimile function to be assigned to the printer without increasing the area to be occupied by the printer.

Figure 14:
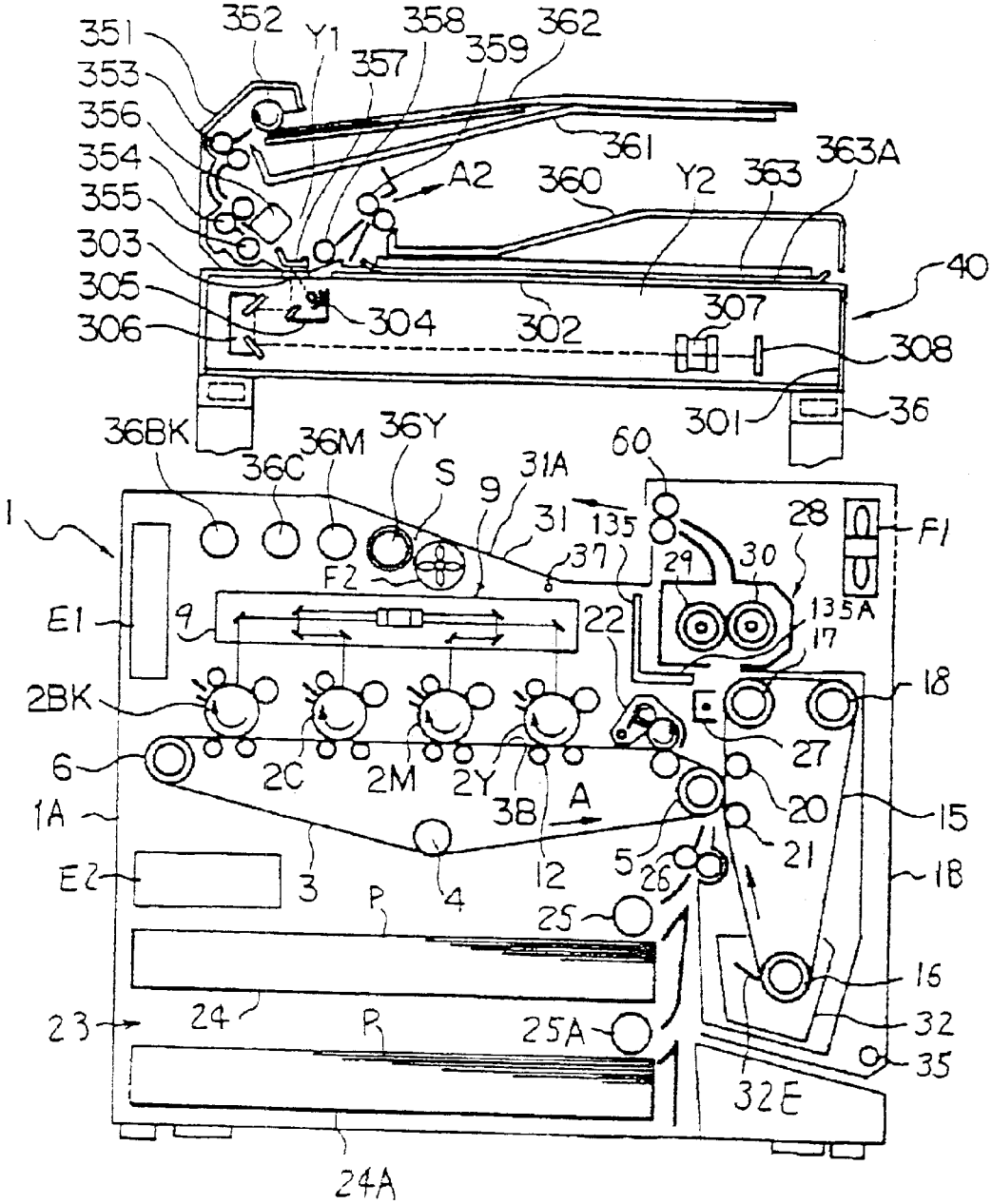
FIG. 14 is a section of the apparatus shown in FIG. 12.

As shown in FIGS. 13 and 14, the scanner 40 set on the upper support portions 39 of the stand 36 may include an ADF (Automatic Document Feeder). In the image forming apparatus shown in FIG. 14, the drums 2Y through 2BK are positioned above the horizontal upper run 3B of the first belt 3 while the exposing unit 9 is positioned above the drums 2Y through 2BK. The space S accommodating the toner containers 36Y through 36BK intervenes between the exposing unit 9 and the tray 31 of the housing 1. As for the rest of the construction, the image forming apparatus is identical with the apparatus shown in FIG. 1.

The scanner 40 includes a frame 301 supporting glass platens 302 and 303 on its upper portion. A first carriage 305 including a light source 304 and a mirror and a second carriage 306 including mirrors are arranged in the frame 301 in such a manner as to be movable in parallel to the glass platen 302. The second carriage 306 is implemented by conventional optics movable at a speed that is one-half of the speed of the first carriage 305. When the light source 304 illustrates a document, the resulting reflection from the document is incident on a CCD (Charge Coupled Device) image sensor 308 via a lens 307. The CCD image sensor 208 outputs image data or digital signal corresponding to the incident image light. The image data are sent to a remote station by the facsimile function of the apparatus or printed out on the sheet by the apparatus. The image data may be fed to a computer and edited, if desired.

The ADF includes a cover plate 363 for pressing a stack of documents. When the cover plate 363 is lifted, it uncovers the glass platens 302 and 303. The cover plate 363 presses even a book document or similar thick document. As for a stack of documents having several pages, the stack is set on a movable plate 362, which is mounted on a document tray 361, with the first page facing upward. When a pickup roller 352 is rotated in a direction indicated by an arrow, it pays out the top document toward a conveying section 351. At this instant, a separator roller pair 353 surely separates the top document from the underlying documents. The document is conveyed by rollers 354, 355 and 358 and then driven out of the ADF by an outlet roller pair 359 in a direction indicated by an arrow A2. Such documents are sequentially stacked on a tray 360 with the first page facing downward.

An image sensor 356, which is a specific form of first reading means, reads the second page before the first page is driven out. Subsequently, when the first page is moving between the cover plate 357 and the glass platen 303, the optics stated earlier, which is a specific form of second reading means, reads the first page. When the second reading means reads the sheet moving on the glass platen 303, the first and second carriages 305 and 306 are held stationary at a preselected reading position. Therefore, both sides of the document are read at two spaced positions by being conveyed one time. Let the reading position where the document is read while in movement and the reading position where it is read while in a stop will be referred to as reading portions Y1 and Y2, respectively.

A white sheet 363A is adhered to the portion of the cover plate 363 expected to contact the document stack because the reading means is apt to read the color of the cover plate as a background when the document is extremely thin. For the same reason, the roller 355 and a sheet presser 357 are colored white.

Figure 15:
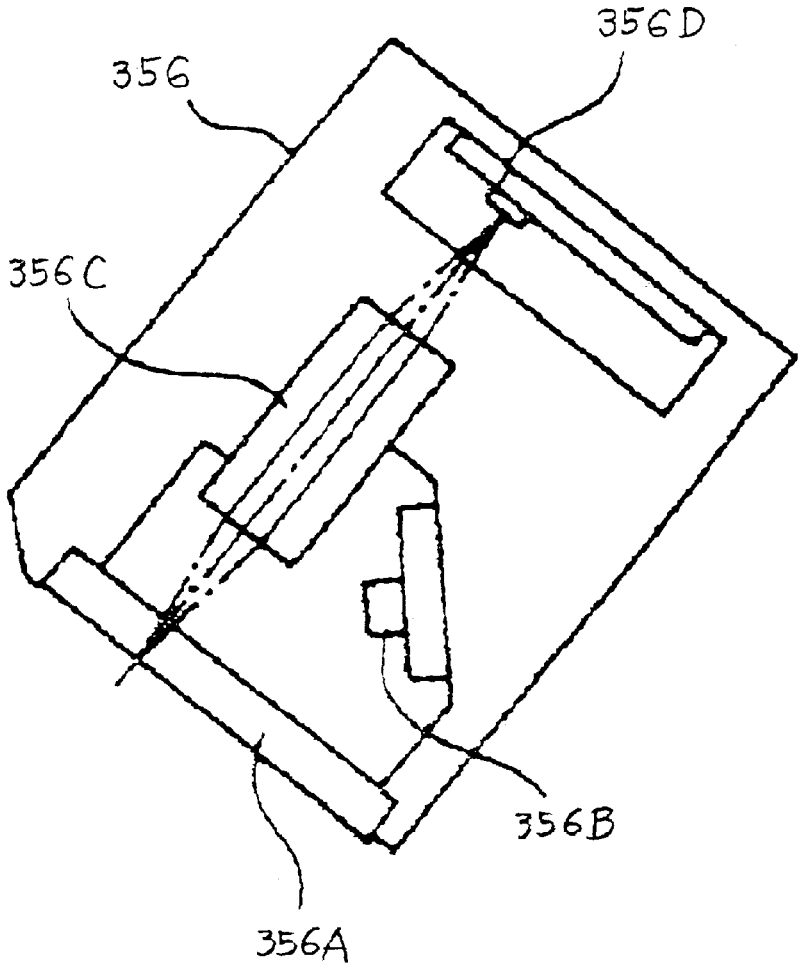
FIG. 15 is a view showing an image sensor included in the scanner.

FIG. 15 shows the image sensor 356 in a section. As shown, the image sensor 356 includes a glass sheet 356A to face the document, an LED (Light-Emitting Diode) array or similar light source 356B for illuminating the document, a lens array or focusing device 356C, and a x1 sensor 356D. If desired, such an image sensor may be replaced with a contact type sensor not including a lens.

The ADF is removably mounted on the apparatus body. When a book document is set on the glass platen 302, the cover plate 363 presses it downward. At this instant, the first reading portion Y1 is lifted together with the ADF body with the result that the sheet presser 357 is spaced from the second glass platen 303. In light of this, a sensor, not shown, responsive to the sheet presser 357 spaced from the glass platen 303 is used. The first reading portion Y1 is inhibited from being used on the basis of the output of the sensor. This prevents a sheet document from being read with a book document existing on the glass platen 303.

Assume that an urgent reading and image forming operation is required when sheet documents are sequentially read at the first reading portion Y1. Then, even if sheet documents are present on the document tray 361 or the tray 360, the second reading portion Y2, i.e., the glass platen 302 and cover plate 363 can be used for an interrupt job. The interrupt job can be input on the operation panel by the operator.

The scanner 40 includes first and second reading means for reading opposite sides of a duplex document and can therefore rapidly scan opposite sides of a duplex sheet document.

The mode in which the first and second images are transferred to opposite sides of a single sheet at the same time has been stated earlier with reference to FIG. 1. There is available another mode in which the composite color image transferred from the drums 2Y through BK to the first belt 3 is directly transferred to a sheet, in which case the sheet P carrying only the above color image is passed through the fixing means 28. This alternative mode will be described hereinafter.

In any one of FIGS. 1, 4, 6 and 7, the color image formed on the first belt 3 is transferred to the sheet P fed from the sheet feeding device 23 by the image transfer roller 20. When the sheet P with the toner image is conveyed upward in contact with the surface of the second belt 15, the corona discharger 27 is not energized. Subsequently, the sheet or print S is driven out to the tray 31 via the fixing means 28. At this instant, the tray 31, first belt 3 and second belt 15 are positioned such that the print P coming out of the fixing means 28 is laid on the tray 31 with the color image facing downward. Consecutive prints P are therefore successfully stacked on the tray 31 in order of page.

In another alternative mode, the composite color image formed on the first belt 3 is transferred to the second belt 15 and then transferred to the sheet P, in which case the sheet P carrying only the above color image will be passed through the fixing means 28.

In a further alternative mode, which is a monochrome mode, a toner image is transferred from one of the drums 2Y through 2BK to the first belt 3 and then transferred to the sheet P.

As stated above, images can be printed on sheets P in desired one of various modes. The fixing condition of the fixing means 28 may be switched in accordance with the mode selected. Specifically, the fixing means 28 fixes an image formed on only one side of a sheet P with a smaller amount of heat than when it fixes images formed on both sides of a sheet P. More specifically, in the case of a simplex print carrying an image on one side thereof, heating means facing the other side of the print generates a smaller amount of heat or generates no heat.

FIGS. 10 and 11 each show a specific image forming system or network in which the image forming apparatuses stated earlier are connected to a single host computer HC. The image forming apparatuses play the role of output units (printers) controlled by the host computer HC and may communicate with the host computer HC via wires or by radio.

The operator of the host computer HC can input desired image forming conditions in accordance with guidance appearing on the display of the host computer HC. Also, the image forming apparatuses each can display its conditions on the display. The operator input commands on either one of the operation panel OP and the keyboard of the host computer HC, as desired. For example, the operator may select a duplex print mode by pressing a duplex key provided on the operation panel OP or may select any one of the sheet cassettes by pressing a corresponding key.

The network described above allows the operator of the host computer HC to produce prints in accordance with the purpose of information to deal with or the kind of sheets. In addition, the operator can set desired image forming conditions at a position remote from the image forming apparatuses.

The present invention is similarly applicable to an image forming apparatus other than one that conveys the sheet P from the bottom to the top, as stated above, as will be described hereinafter.

Figure 16:
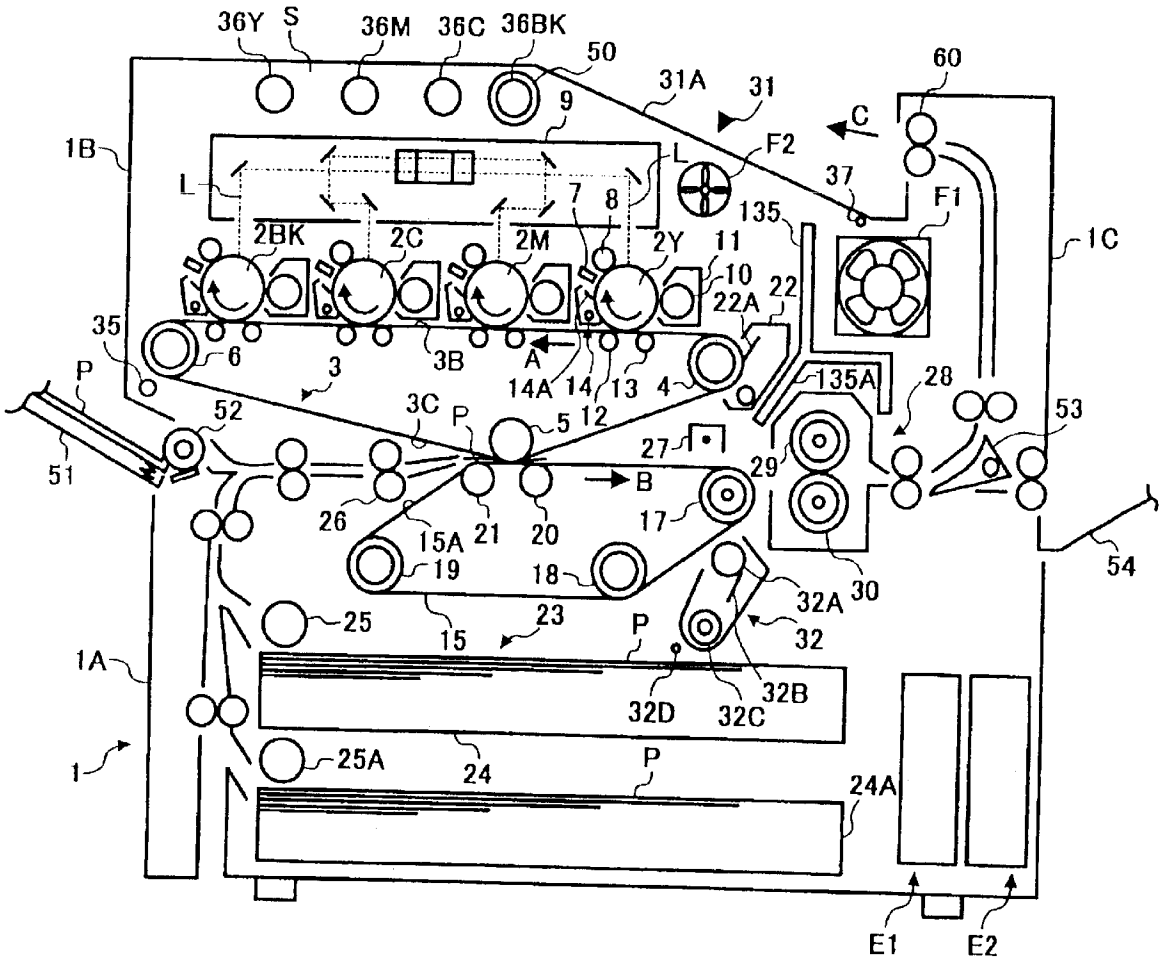
FIG. 16 is a vertical section showing a fifth embodiment of the present invention.

FIG. 16 shows a fifth embodiment of the image forming apparatus in accordance with the present invention. As shown, the image forming apparatus includes the sheet feeding device 23 loaded with ordinary sheets P and a manual sheet feeding device 51 available for thick sheets and other special sheets P. The sheet P fed from either one of the sheet feeding devices 23 and 51 is conveyed in the horizontal direction via the consecutive image forming stations and further conveyed in the horizontal direction to the fixing means 28. The following description will concentrate on differences between the illustrative embodiment and the previous embodiments.

In FIG. 16, the first belt 3 is also passed over the support rollers 4 through 6 and moved in the direction A. The drums 2Y through 2BK are arranged side by side along the upper run 3B of the first belt 3 while the exposing unit 9 is positioned above the drums 2Y through 2BK. The drums 2Y through 2BK are rotated in contact with the first belt 3. The first image is formed on the first belt 3 in exactly the same manner as in the previous embodiments. The first image is then transferred from the first belt 3 to the second belt 15, which is passed over the support rollers 17 through 21 and movable in the direction B.

In the illustrative embodiment, the second belt 15 is positioned below the first belt 3. The support roller 5 is pressed against the second belt 15 between the support roller 21 and the image transfer roller 20 via the first belt 3. In this condition, the first image is transferred from the first belt 3 to the second belt 15. Subsequently, the second image is formed on the first belt 3.

The sheet feeding device 23 including the cassettes 24 and 24A and pickup rollers 25 and 25A is positioned below the second belt 15. The sheet P is fed from either one of the sheet cassettes 24 and 24A to the registration roller pair 26. Alternatively, the sheet P may be set on the manual sheet feeding device 51, which is positioned at the left-hand side of the second belt 15, in which case a pickup roller 52 will feed the sheet P toward the registration roller pair 26.

The image transfer roller 20 transfers the second image from the first belt 3 to the other side of the sheet P being conveyed by the registration roller pair 26 in the horizontal direction. At the same time, the corona discharger 27 transfers the first image from the second belt 15 to one side of the same sheet P. The sheet P is then separated from the second belt 15 by the support roller 17 on the basis of curvature. Subsequently, the images carried on both sides of the sheet S are fixed by the fixing means 28.

A path selector or switching means 53 is located downstream of the fixing means 28 in the direction of sheet conveyance. The path selector 53 is movable between a position where it steers the sheet P coming out of the fixing means 28 upward toward the tray 31 (arrow C) or steers the same toward another tray 54, which is positioned at the right-hand side of the path selector 53.

The cleaning unit 32 assigned to the second belt 15 is configured and operated in the same manner as the cleaning unit 32 shown in FIG. 4.

In any one of the image forming apparatuses described above, the second belt 15 is passed over a plurality of support members. The image transfer roller 20 constituting the second and fourth image transferring means contacts the inner surface of the second belt 15. A bias opposite in polarity to the first or the second image formed on the first belt 3 is applied to the image transferring means, thereby transferring the first image to the second belt 15 or the second image to the other side of the sheet P.

Figure 17:
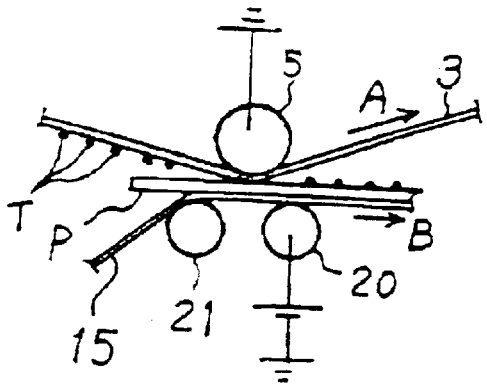
FIG. 17 shows an image transfer roller included in the fifth embodiment and playing the role of second and fourth image transferring means.

FIG. 17 shows the image transfer roller 20 of FIG. 16 in an enlarged scale. As shown, the sheet P is conveyed between the first belt 3 and the second belt 15 while the image on the first belt 3 is transferred to the sheet P. The support roller 5 is connected to ground. A positive bias is applied to the image transfer roller 20 so as to transfer toner grains T of negative polarity, which form the image on the first belt 3, to the sheet P being conveyed by the first belt 3.

In the configuration shown in FIG. 17, the bias applied to the image transfer roller 20 is of the same polarity as the bias applied to the image transfer roller or first image transferring means 12. The image transfer rollers 20 and 12 therefore can be applied with the biases from identical power supplies or can share a single power supply, simplifying the image forming apparatus and facilitating the supply and storage of parts.

Figure 18:
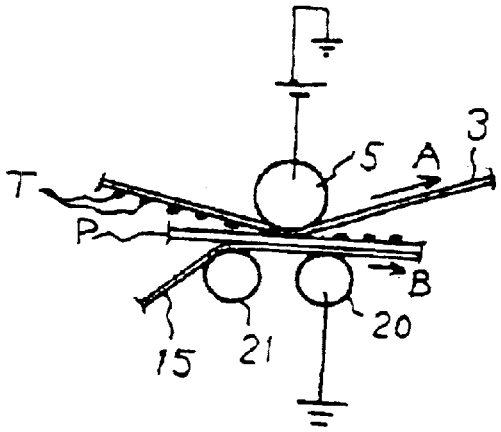
FIG. 18 shows a support roller included in the fifth embodiment and playing the role of the second and fourth image transferring means.

FIG. 18 shows another specific configuration in which the support roller 5 plays the role of the second and fourth image transferring means. As shown, when the first intermediate image transfer belt 3 is implemented as a belt, as stated above, the support roller 5 contacts the inner surface of the first belt 3. In this configuration, a bias of the same polarity as the toner grains forming the first or the second image on the first belt 3, i.e., negative polarity is applied to the support roller 5, thereby transferring the first image from the first belt 3 to the second belt 15 or the second image from the first belt 3 to the other side of the sheet P. The roller 20 is connected to ground.

In FIG. 18, the support roller 5 faces the sheet P without the intermediary of the second belt 15. Therefore, a preselected current can be fed to the support roller 5 for transferring the image from the first belt 3 to the sheet P without regard to the thickness of the sheet P. More specifically, even when the sheet P is relatively thick, it is not necessary to, e.g., increase the current to be fed to the support roller 5, promoting simple control.

When the configuration of the fifth embodiment is applied to any one of the first to fourth embodiments shown in FIGS. 1, 4, 6 and 7, the support roller or second and fourth image transferring means 5, a plurality of image transfer rollers or first image transferring means 12 and corona discharger or third image transferring means 27 all are mounted on the stationary housing 1A. Therefore, the power supply unit E2 mounted on the stationary housing 1A can feed a current to all of such image transferring means. This makes it needless to mount a power supply unit on the movable housing 1B and therefore simplifies the construction of the image forming apparatus. Assume that the configuration of FIG. 17 is applied to any one of the first to fourth embodiments. Then, if a contact, not shown, provided on the stationary housing 1A and a contact, not shown, provided on the movable housing 1B are brought into contact, then a current may be fed from the power supply unit E2 to the image transfer roller 20. Such contacts, however, make the image forming apparatus sophisticated and are apt to bring about troubles ascribable to incomplete contact.

Figure 19:
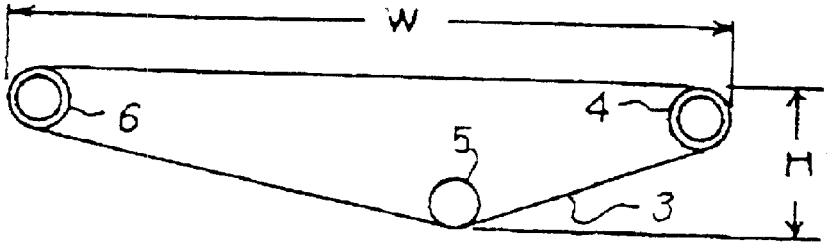
FIG. 19 shows a first intermediate image transfer body included in the fifth embodiment.

In the embodiment shown in FIG. 16, the first intermediate image transfer body 3 is implemented as a belt. As shown in FIG. 19, the first belt 3 has a height H smaller than a width W in the horizontal direction. The second belt or intermediate image transfer body 15 is positioned below the first belt 3. In addition, the sheet path, first belt 3 and second belt 15 are positioned relative to each other such that the sheet P is conveyed substantially horizontally between the first belt 3 and the second belt 15. This kind of arrangement prevents the image forming apparatus from being excessively increased in height.

In the embodiment shown in FIG. 16, the sheet P fed from the manual sheet feeding device 51 is conveyed toward the tray 54 via the fixing device 28 along the horizontal, substantially linear sheet path. Therefore, even a thick, rigid special sheet can be stably conveyed without jamming the sheet path. Further, the ordinary sheet P can be fed from desired one of the sheet feeding devices 23 and 51 to desired one of the trays 31 and 54. On the other hand, the thick sheet, OHP (OverHead Projector) film or similar special sheet P can be fed from the manual sheet feeding section 51 toward the tray 54 in order to avoid a jam.

In the illustrative embodiments including the embodiment of FIG. 16, the sheet feeding device 23 lies in the range below the image transfer position where an image is transferred to the sheet P. The second intermediate image transfer body 15 is implemented as an endless belt. The image forming means 28, i.e., the nip between the first and second heating means 29 and 30 is positioned at the surface portion of the second belt 15 that conveys the sheet P coming out of the nip between the first and second belts 3 and 15 toward the fixing means 28 or an extension of the above surface. In this configuration, the sheet P can smoothly enter the fixing portion of the fixing means 28 without its images being disturbed.

In the illustrative embodiment, part 3C of the first belt 3 and part of the second belt 15 positioned upstream of the image transfer position in the direction of sheet conveyance are configured such that they are set back from the registration roller pair 26. The registration roller pair 26 can therefore be freely laid out without interfering with the first belt 3 or the second belt 15. Only one of the first and second belts 3 and 15 may be so configured, if desired. The crux is that at least one of the above parts of the first and second intermediate image transfer bodies is set back from a horizontal line passing through the image transfer position away from the registering means.

Figure 20:
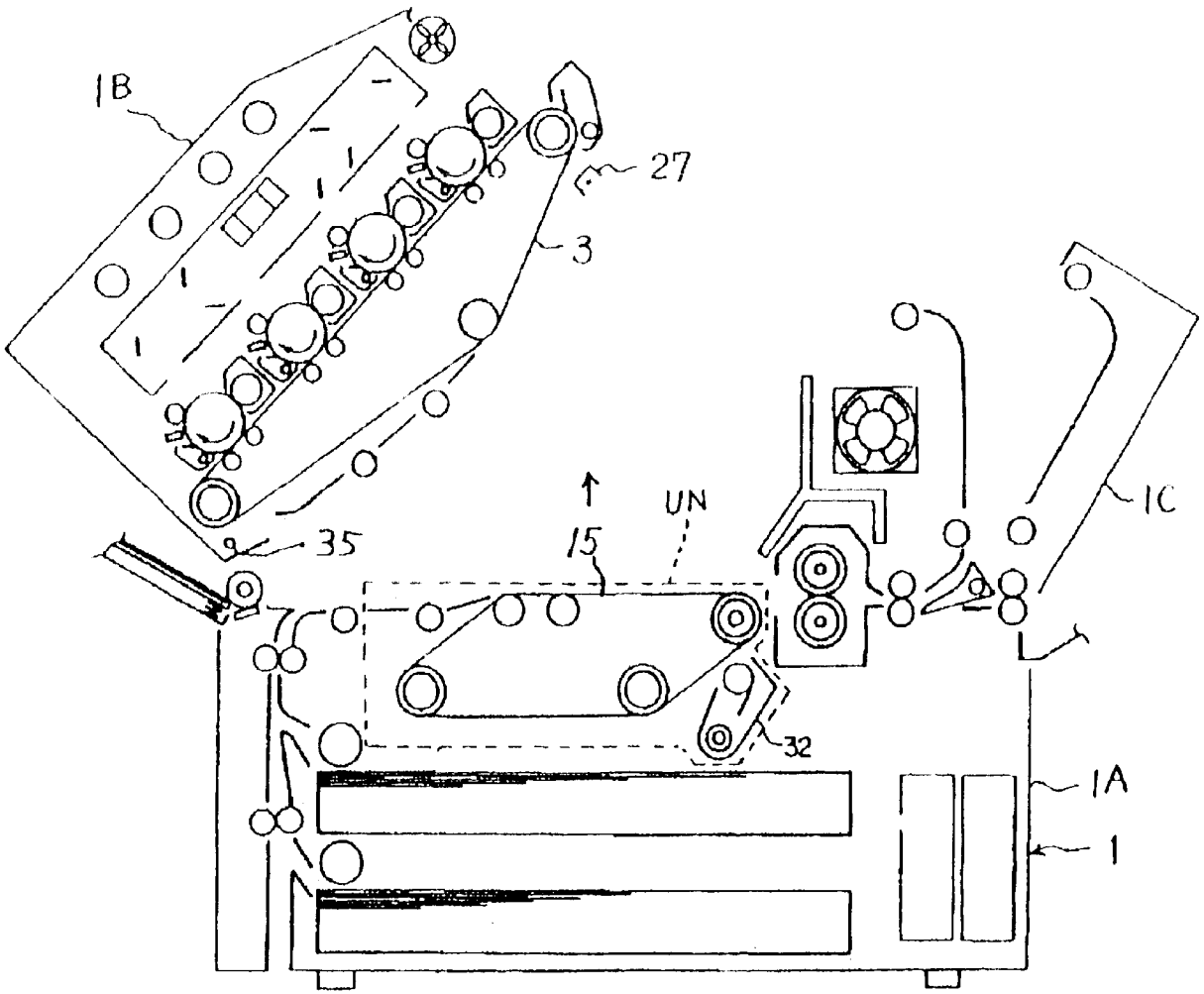
FIG. 20 is a section showing a movable housing included in the fifth embodiment in an open position.

As shown in FIG. 20, the housing 1 of the illustrative embodiment is also made up of the stationary housing 1A and movable housing 1B facing the stationary housing 1A with the intermediary of the sheet path and openable upward away from the housing 1A. More specifically, the movable housing 1B is hinged to the stationary housing 1A via a shaft 35. The first belt 3 and second belt 15 are respectively mounted on the movable housing 1B and stationary housing 1A such that the belts 3 and 15 are moved away from each other when the housing 1B is opened. This is also successful to allow a sheet P jamming the path between the belts 3 and 15 to be easily removed.

The third image transferring means (corona discharger 27 in the illustrative embodiment) is mounted on the movable housing 1B such that it is exposed to the outside when the movable housing 1B is opened. Therefore, when the movable housing 1B is opened, the sheet path between the belts 3 and 5 is widely opened so as to insure easy access.

In the embodiment shown in FIGS. 16 and 20, the housing 1 additionally includes another movable housing 1C. As shown in FIG. 20, when the movable housing 1B should be opened, the movable housing 1C is opened to facilitate the opening of the housing 1B. Also, the movable housing 1C also facilitates the removal of a jamming sheet when opened.

In any one of the image forming apparatuses described above, when the movable housing 1B is opened, at least one of the first and second belts 3 and 15 is removable from the housing 1 and can therefore be easily replaced.

When the movable housing 1B is opened, as shown in FIG. 20, it is held in the open position by a gas cylinder or similar supporting means and facilitates jam processing or the replacement or similar maintenance of the corona discharger 27 or that of the belts 3 and 15. Further, the structural elements surrounded by a phantom line in FIG. 20 may be constructed into a unit UN removable from above the stationary housing 1A. When the top of the housing 1 is not openable, as the case may be, then the unit UN may be so supported as to be lowered to release the belts 3 and 15 from each other.

The illustrative embodiment, too, includes protecting means for protecting the toner containers 36Y through 36BK. In the illustrative embodiment, the protecting means bifunctions as heat insulating means intervening between the fixing means 28 and the cleaning unit 22 assigned to the first belt 3. More specifically, as shown in FIG. 16, the heat insulating member 135 includes a portion 135A intervening between the fixing means 28 and the cleaning unit 22 in order to prevent the heat of the fixing means 28 from being transferred to the cleaning unit 22. This configuration of the heat insulating member 135 is applied to the embodiment of FIG. 14 as well.

The arrangements shown in FIGS. 1 through 15 may be suitably applied to the embodiment of FIG. 16 as well.

As stated above, the embodiments shown and described are capable of forming color images on both sides of a sheet P in a short period of time and therefore enhances productivity.

Figure 21:
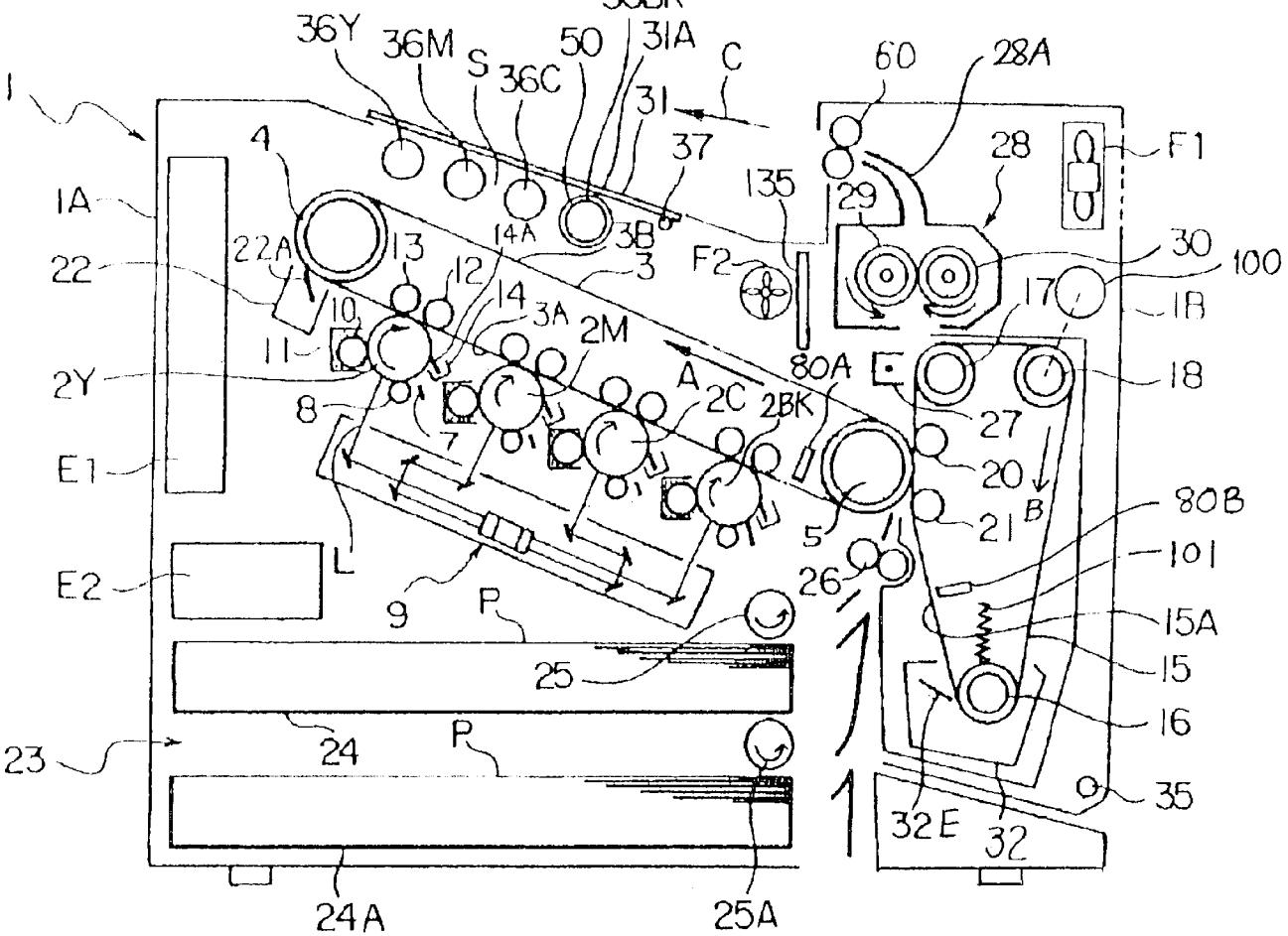
FIG. 21 is a section showing a sixth embodiment of the present invention.

Reference will be made to FIG. 21 for describing a sixth embodiment of the present invention. Because this embodiment is essentially similar to the first embodiment shown in FIG. 1, identical structural elements are designated by identical reference numerals and will not be described specifically in order to avoid redundancy. The following description will concentrate on difference between this embodiment and the embodiment of FIG. 1.

Figure 22A:
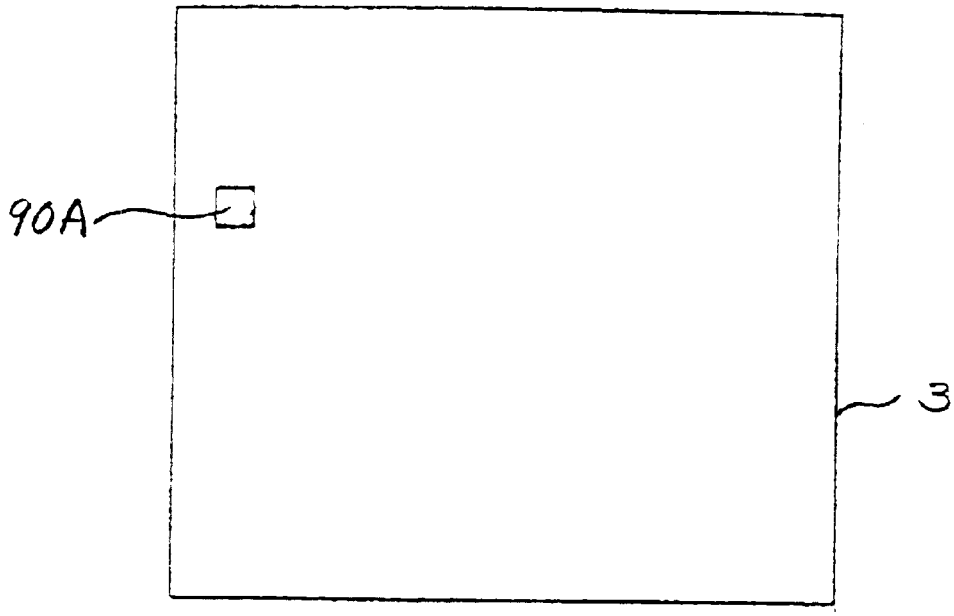
FIGS. 22A and 22B show timing marks particular to the sixth embodiment.

In the illustrative embodiment, the first belt 3 includes a 50 $\mu$m to 500 $\mu$m thick base implemented as a resin film or a rubber base. A coating layer with low surface energy is formed on the base to provide the entire belt with volume resistivity of $10^6$ Ω.cm to $10^{12}$ Ω.cm and surface resistivity of $10^5$ Ω/cm$^2$ to $10^{12}$ Ω/cm$^2$. The inner surface of the first belt 3 is colored gray or black while a timing mark 90A shown in FIG. 22*a* is printed on the preselected position of the inner surface of the belt 3. In the illustrative embodiment, the timing mark 90A is implemented as a 6 mm square, white mark.

Sensing means or control means 80A responsive to the timing mark 90A is positioned between the opposite runs of the first belt 3, i.e., in the loop of the belt 3. The sensing means 80A is implemented by a conventional reflection type optical sensor.

Figure 23:
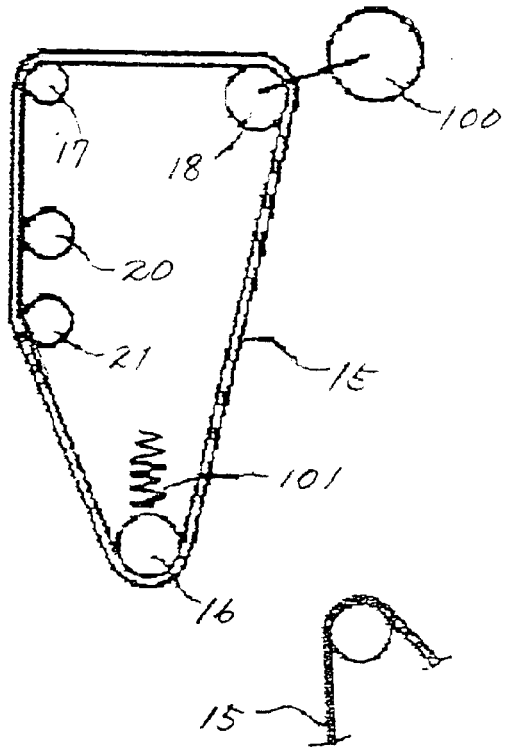
FIG. 23 shows a second intermediate image transfer body included in the sixth embodiment.

As shown in FIGS. 21 and 23, the second belt 15 is passed over a drive roller 18 driven by a motor 100, a tension roller 16 biased by tension means 101, a separator roller 17 having a relatively small diameter as well as the image transfer roller 20 and back roller 21. The separator roller 17 has a diameter as small as 12 mm to 25 mm and implemented by a metallic core covered with rubber or resin or a metallic tube provided with a brush. The separator roller 17 with such a small diameter allows the sheet P being conveyed by the second belt 15 to be easily separated from the belt 15, thereby obviating the need for exclusive discharging means for separation.

The separator roller 17 is positioned in the vicinity of the fixing unit 28 and therefore susceptible to heat if its surface is formed of metal. In addition, if the separator roller 17 has a large thermal capacity, then it applies heat to the second belt 15 over a long period of time. As a result, although the belt 15 is resistant to heat, it is apt to deform due to the heat and the tension ascribable to the tension roller 16. This is why the separator roller 17 is formed of the material stated above. To connect the separator roller 17 to ground, the roller 17 should preferably be formed of conductive rubber, conductive resin or conductive brush.

Figure 24:
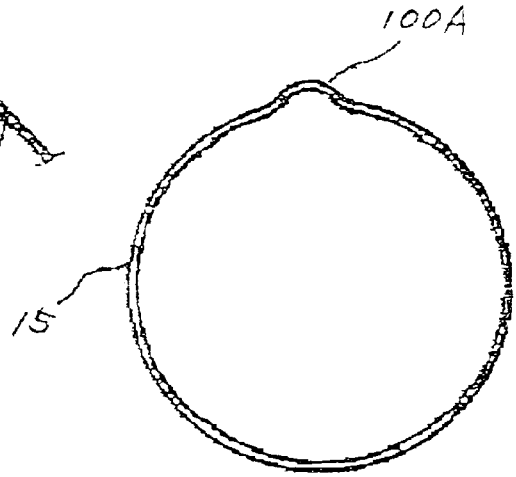
FIG. 24 is a view for describing a curl to appear on the second intermediate image transfer body.

As shown in FIG. 24, although the diameter of the separator roller 17 should preferably be small enough to promote the separation of the sheet P, a curl or projection 100A is formed in part of the second belt 15 when it is left on the separator roller 17 for a long period of time roller under tension and then made free. The curl 100A gives rise to a serious problem to be described hereinafter.

Figure 25:
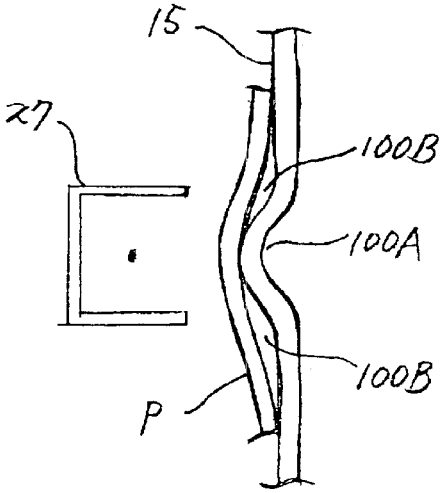
FIG. 25 is a view demonstrating how the curl of FIG. 24 degrades image quality.

As shown in FIG. 25, the curl 100A of the second belt 15 forms gaps 100B between the belt 15 and the sheet P being conveyed by the belt 15. The gaps 100B cause a toner image to be locally lost without being transferred. This problem will not occur if the image transferring means is implemented as, e.g., a roller that allows the sheet P and belt 15 to fully contact each other. However, in the image forming apparatus of the type transferring toner to both sides of the sheet P substantially at the same time, a roller should not be pressed against the side of the sheet P carrying a toner image.

Figure 22B:
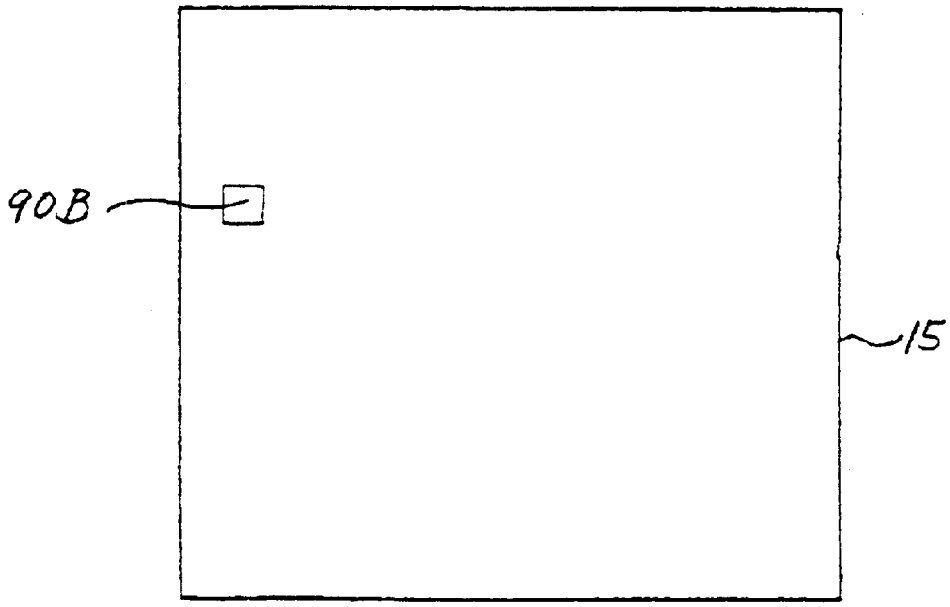

In light of the above, it is preferable to prevent the second belt 15 from stopping at the same position every time image formation ends. The belt 15 is heat-resistant and has resistance that allows toner to be directly transferred from the first belt 3 or allows it to be transferred from the belt 15 to the sheet P. The belt 15 has a 50 $\mu$m to 500 $\mu$m thick base formed of polyimide or polyamideimide and coated with fluorine or similar substance having low surface energy. The belt 15 has a volume resistivity ranging from $10^6$ Ω.cm to $10^{12}$ Ω.cm and a surface resistivity ranging from $10^5$ Ω/cm$^2$ to $10^{12}$ Ω/cm$^2$. As shown in FIG. 22*b,* a timing mark 90B is also printed on the inner surface of the belt 15. Sensing means or control means 80 responsive to the timing mark 90 is positioned in the loop of the belt 15 and may also be implemented by a reflection type optical sensor.

Figure 26:
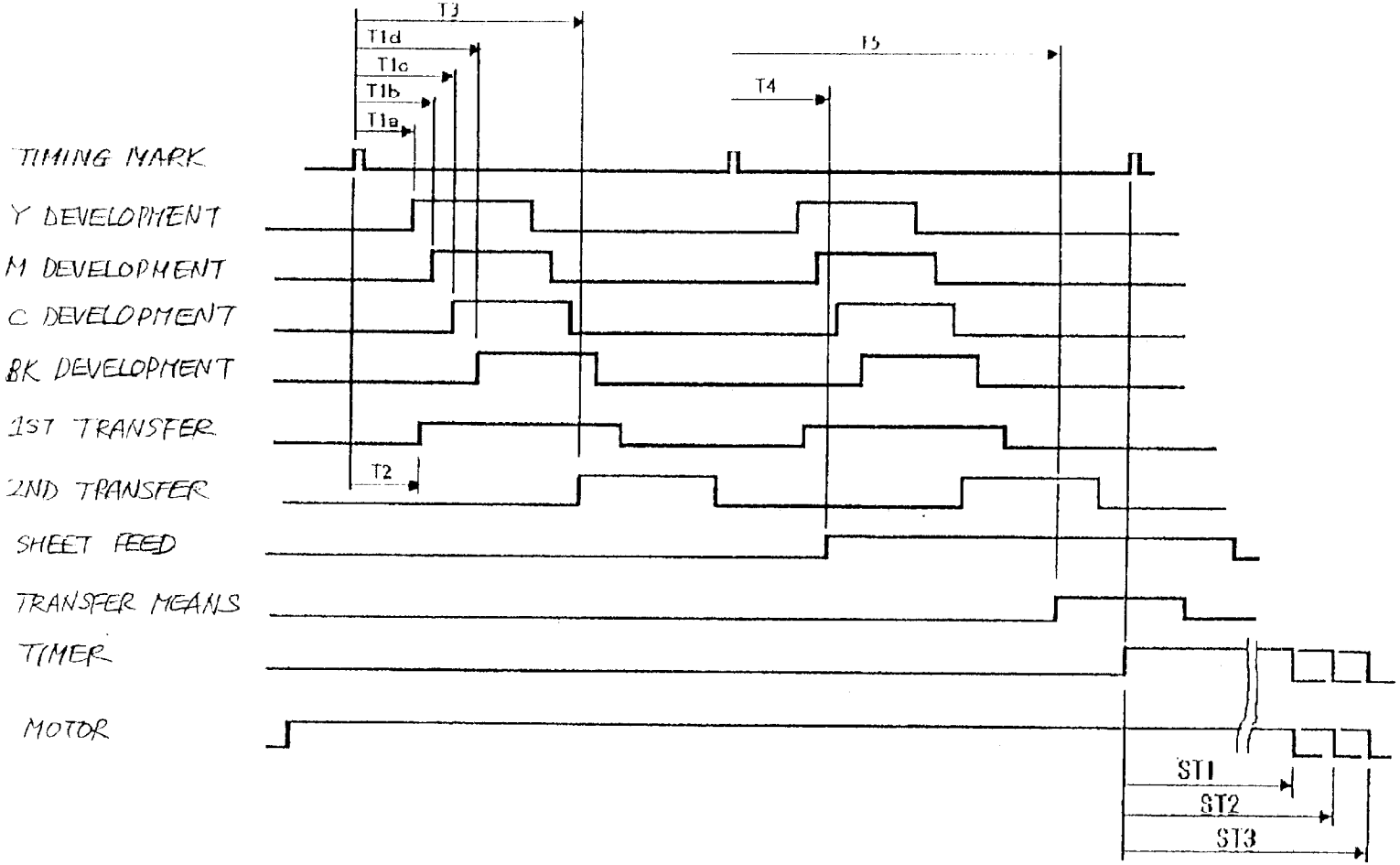
FIG. 26 is a timing chart representative of a control procedure to be executed by the sixth embodiment in the duplex print mode.

A duplex print mode available with the illustrative embodiment will be described hereinafter with reference also made to FIG. 26. When the sensing means 80A and 80B respectively sense the timing marks 80A and 80B of the belts 3 and 15 (time T1*a,* FIG. 26), a toner image is formed by use of the drum or first image carrier 2Y. Specifically, the exposing unit 9 scans the uniformly charged surface of the drum 2Y in accordance with image data to thereby form a latent image. The developing unit 11 associated with the drum 2Y develops the latent image to thereby produce a corresponding yellow toner image. The image transfer roller 12 transfers the yellow toner image from the drum 2Y to the first belt 3 moving in synchronism with the drum 2Y (time T2). After the image transfer, the cleaning unit 14 cleans the surface of the drum 2Y with the cleaning member 14A. Subsequently, the discharger 7 discharges the cleaned surface of the drum 2Y to thereby prepare it for the next image forming cycle.

A magenta toner image is formed on the drum or second image carrier 2M in exactly the same manner as the yellow toner image formed on the drum 2Y. The magenta toner image is transferred from the drum 2M to the first belt 3, which is moving in the direction A, over the yellow toner image existing on the belt 3. Subsequently, a cyan and a black toner image are sequentially transferred to the belt 3 over the toner images existing on the belt 3, completing a four-color or full-color image.

The timing for starting forming the individual image of particular color is controlled on the basis of a period of time counted from the time when the timing marks 90A and 90B are sensed (times Tb1 through T1d). At this time, the second belt 15 is moving in the direction B in synchronism with the first belt 3. The image transfer roller 20 transfers the full-color image from the belt 3 to the belt 15 at a timing also controlled on the basis of the above timing (time T3). Such a procedure executed with the tandem configuration reduces the image forming time.

When the belts 3 and 15 complete one turn each, the timing marks 90A and 90B are again sensed by the sensing means 80A and 80B, respectively. At this instant, when one of the timing marks 90A and 90B is sensed by one of the sensing means 80A and 80B before the other timing mark, the operation waits until the other timing mark is sensed by the other timing sensor 80A or 80B. It is to be noted that if the belts 3 and 15 have the same circumferential length, then control can be effected if one of the sensing means 80A and 80B and one of the timing marks 90A and 90B are used. When the timing marks 90A and 90B both are sensed, the second image to be transferred to the other side of the sheet P is formed on the belt 3 in exactly the same manner. On the elapse of a period of time T4, the sheet P starts being fed from, e.g., the sheet cassette 24.

When the sheet P is conveyed to the nip between the belts 3 and 15 via the registration roller pair 26, the image transfer roller 21 transfers the toner image from the belt 3 to one side of the sheet P. This image transfer timing is also controlled on the basis of a period of time counted from the time when the timing marks 90A and 90B are sensed. Subsequently, the sheet P is conveyed upward while the charger 27 transfers the toner image from the belt 15 to the other side of the sheet P. At this time, the sheet P is so controlled in timing as to locate the image at an expected position (time T5).

The stop position of the second belt 15 will be described with reference to FIG. 16. Briefly, to control the stop position of the belt 15, an interval between the time when the last output of the sensing means 80B responsive to the timing mark 90B appears after the cleaning of the belt 15 and the time when the motor 100 is deenergized is varied. More specifically, to stop the belt 15 at a usual position, a motor stop time ST1 of, e.g., x seconds is set in a sequence program stored in a main controller. A timer assigned to a motor stop starts counting time in response to the last output of the sensing means 80B. When the timer reaches the motor stop time T1, the controller outputs a motor stop signal. In the illustrative embodiment, the third output of the sensing means 80B is the last output. Likewise, other two motor stops times ST2 and ST3 each being assigned to a particular stop timing are set in the above sequence program.

The program sequence is determined such that motor stop timers ST1, ST2 and ST3 sequentially operate for every job of the image forming apparatus, so that the position where the belt 15 stops is varied. This successfully frees the belt 15 from the curl 100A. Of course, two motor stop timers or four or more motor stop timers may be set in the sequence program instead of the three motor stop timers shown and described.

If desired, the last stop position of the belt 15, e.g., one of the motor stop timers ST1 through ST3 operated last time may be stored in stop position storing means, e.g., a flash memory or a ferroelectric memory (FRAM) or similar nonvolatile IC memory. This prevents the history of the belt 15 from being lost when the main switch of the image forming apparatus is turned off. In such a case, when the main switch is turned on later and the first job ends, the belt 15 is brought to a stop at a position different from the last stop position.

The belt 15 can be selectively stopped at a plurality of positions even if a plurality of motor stop timers are not set in the sequence program. For example, the motor 100 may be implemented as a stepping motor and stopped on the basis of the last output of the sensing means 80B.

Figure 27:
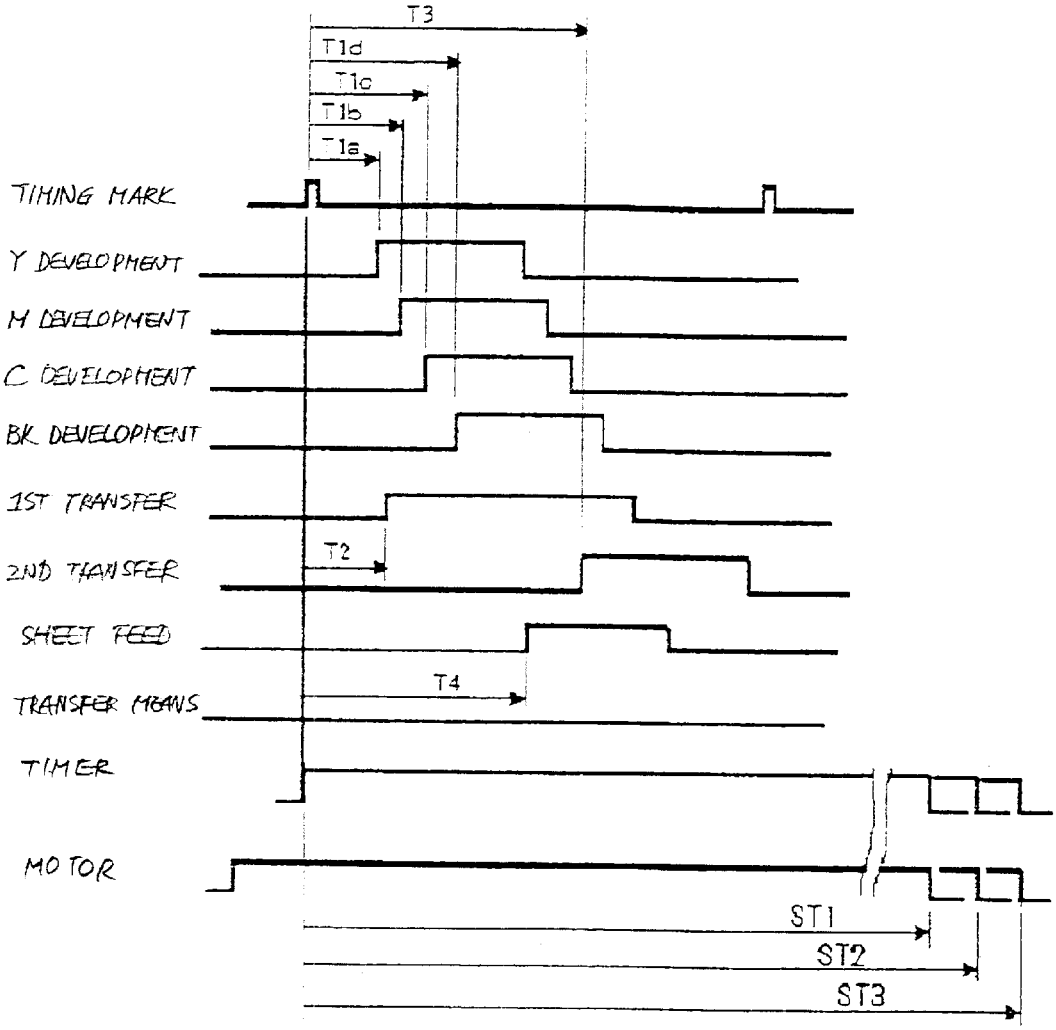
FIG. 27 is a timing chart representative of a control procedure to be executed in the simplex print mode.

FIG. 27 shows a timing chart demonstrating a simplex print mode available with the illustrative embodiment. As shown, in the simplex print mode, the belt 15 should only move by a smaller amount than in the duplex print mode. The first mark is used as a reference mark. The timer starts counting time after the reference mark has been sensed. After image formation, the motor is deenergized in exactly the same manner as in the procedure described above.

In the illustrative embodiment, the toner images formed on the drums 2Y through 2BK are of negative polarity. Therefore, by applying a positive bias to the image transfer rollers 12, the toner images are transferred from the drums 2Y through 2BK to the first belt 3. Subsequently, a positive bias is applied to the image transfer roller 20 to transfer the full-color image completed on the first belt 3 to the second belt 15. The second image formed on the belt 3 is transferred to one side of the sheet P. The toner image of negative polarity carried on the belt 15 is transferred to the other side of the sheet P by the charger 27 to which a positive bias is applied. The sheet or print P carrying the toner images on both sides thereof is routed through the fixing means 28, guides 28A and outlet roller 60 to the tray 31, as stated earlier.

In the duplex print mode, the sheet P is driven out to the tray 31 with the toner image transferred to the sheet P later, i.e., the second image directly transferred from the belt 3 facing downward. Therefore, to stack consecutive prints S on the tray 31 in order of page, the image of the second page should be formed and transferred to the belt 15, and then the image of the first page should be directly transferred from the belt 3 to the sheet P. The images formed on the drums 2Y through 2BK are non-reversed images as to the second image to be directly transferred from the belt 3 to the sheet P or reversed images as to the first image to be transferred from the belt 15 to the sheet P, as stated previously. Such an order of image formation for arranging pages can be implemented by a conventional technology using a memory. Also, switching of non-inverted images and inverted images can be done with a conventional image-processing technology.

The cleaning unit 32 cleans the surface of the belt 15 with the cleaning member 32E after the transfer of the image to the sheet P. Toner conveying means, not shown, conveys toner collected by the cleaning member 32E to a waste toner storing section not shown.

The simplex print mode also available with the illustrative embodiment will be described with reference to FIG. 21. While the simplex print mode may be effected in either one of two different ways, the following description will concentrate on the direct transfer of a toner image from the first belt 3 to the sheet P without the intermediary of the second belt 15. Toner images of different colors are transferred form the drums 2Y through 2BK to the belt 3, completing a full-color image. The sheet P is fed to the nip between the belts 3 and 15 in synchronism with the movement of the belt 3. The image transfer roller 20 transfers the full-color image from the belt 3 to the sheet P.

In the simplex print mode, the charger 27 is not operated. The sheet P is conveyed by the belt 15 to the fixing means 28 and has its toner image fixed thereby. Subsequently, the sheet P is separated from the belt 15 and driven out to the tray 31 face down via the guides 28A and outlet roller 60.

The simplex print mode described above allows the consecutive prints P to be sequentially stacked on the tray 31 in order of page even when several documents are dealt with from the first page to the last page.

Figure 28B:
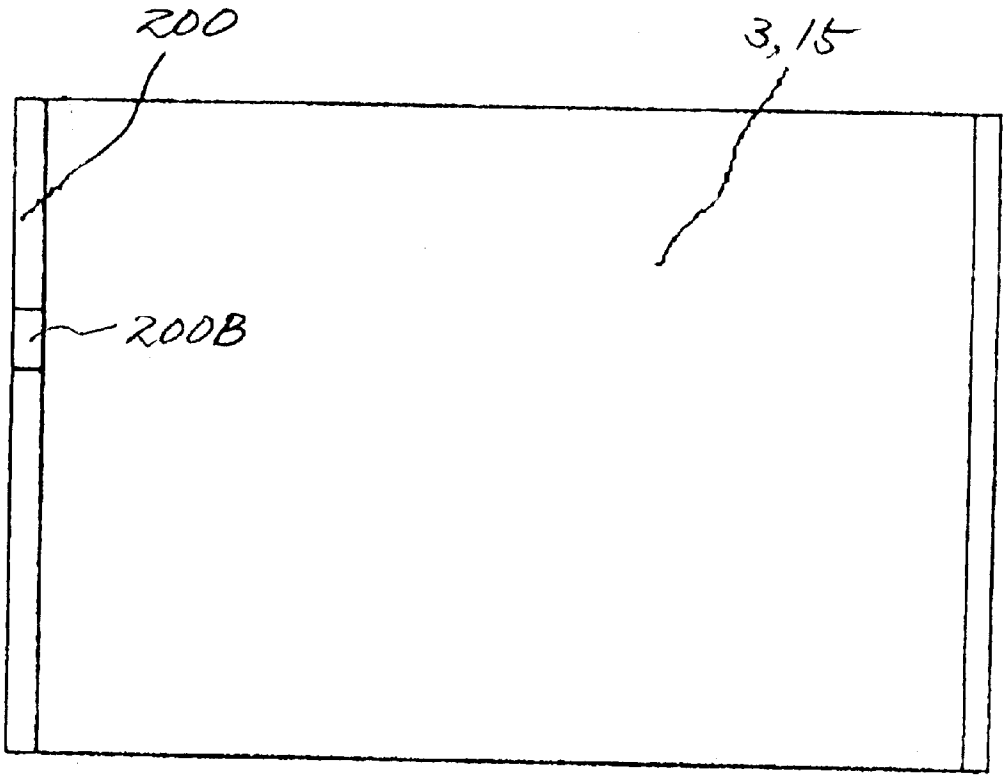
FIGS. 28A and 28B show another specific configuration of the timing mark.
Figure 28A:
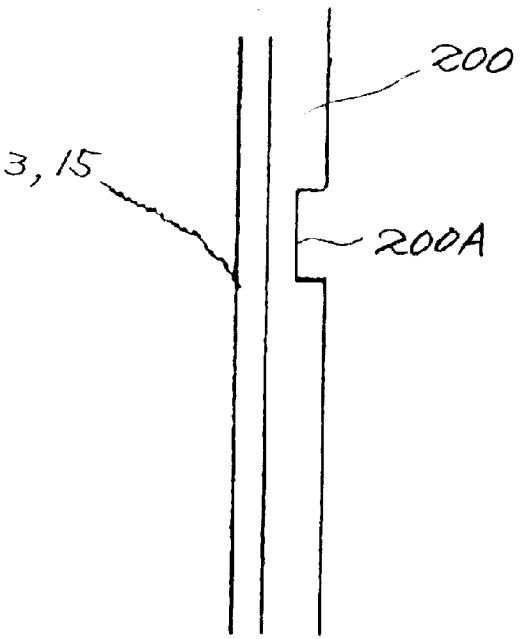

FIGS. 28A and 28B show a specific configuration of the timing mark. As shown, it is a common practice with an image forming apparatus to form ribs 200 at opposite circumferential edges of each of the belts 3 and 15 in order to prevent the belt from being shifted to either side. One of the ribs 200 is partly notched to form a recess 200A or 200B, which plays the role of the timing mark to be sensed by the sensing means 80A or 80B. In this case, for the sensing means, use may be made of a sensor of the kind including an actuator capable of entering the recess 200A or 200B. Alternatively, the recess 200A or B may be provided with a color or a reflectance different from the color or the reflectance of the other part of the rib 200, in which case an optical sensor will be used.

Figure 29A:
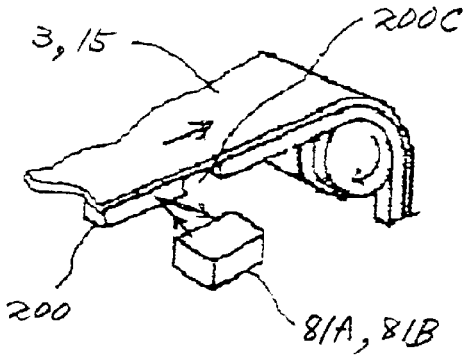
FIGS. 29A through 29D show other specific configurations of the timing mark.
Figure 29B:
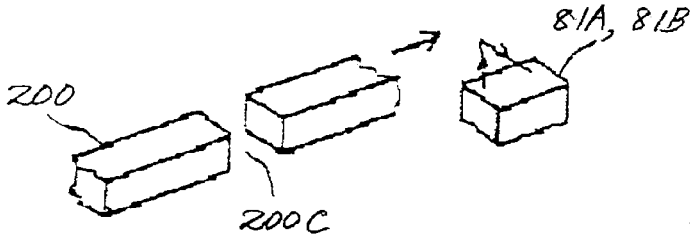
Figure 29C:
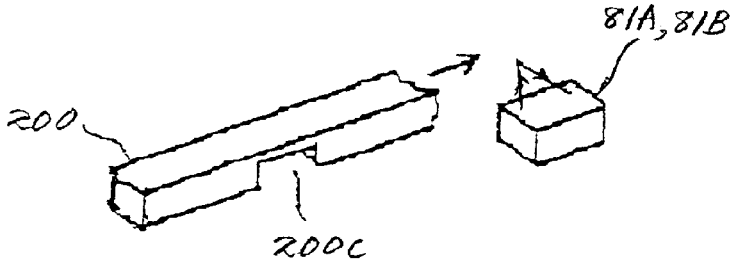
Figure 29D:
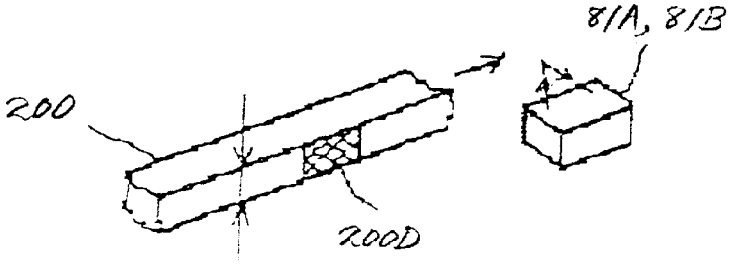

Reference will be made to FIGS. 29A through 29D for describing specific configurations that allow the timing mark to be sensed at one side of the rib. In FIGS. 29*a* through 29C, the rib 200 is partly notched to form a recess 200C to be sensed by reflection type sensing means 81A or 81B. In FIG. 29D, the recess 200C is replaced with a mark 200D provided on the rib 200 and different in color or reflectance from the other part of the rib 200, so that reflection type sensing means can sense the mark 200D. If desired, magnetic sensing means may be used to sense the mark 200D.

Although the sensing means 81A or 81B, like the sensing means 80A or 80B, is optical sensing means, its output is opposite to sensing means that reads a white mark. Specifically, the output of the sensing means 81A or 81B is in an ON state when sensing the projection or in an OFF state when sensing the recess.

Figure 30:
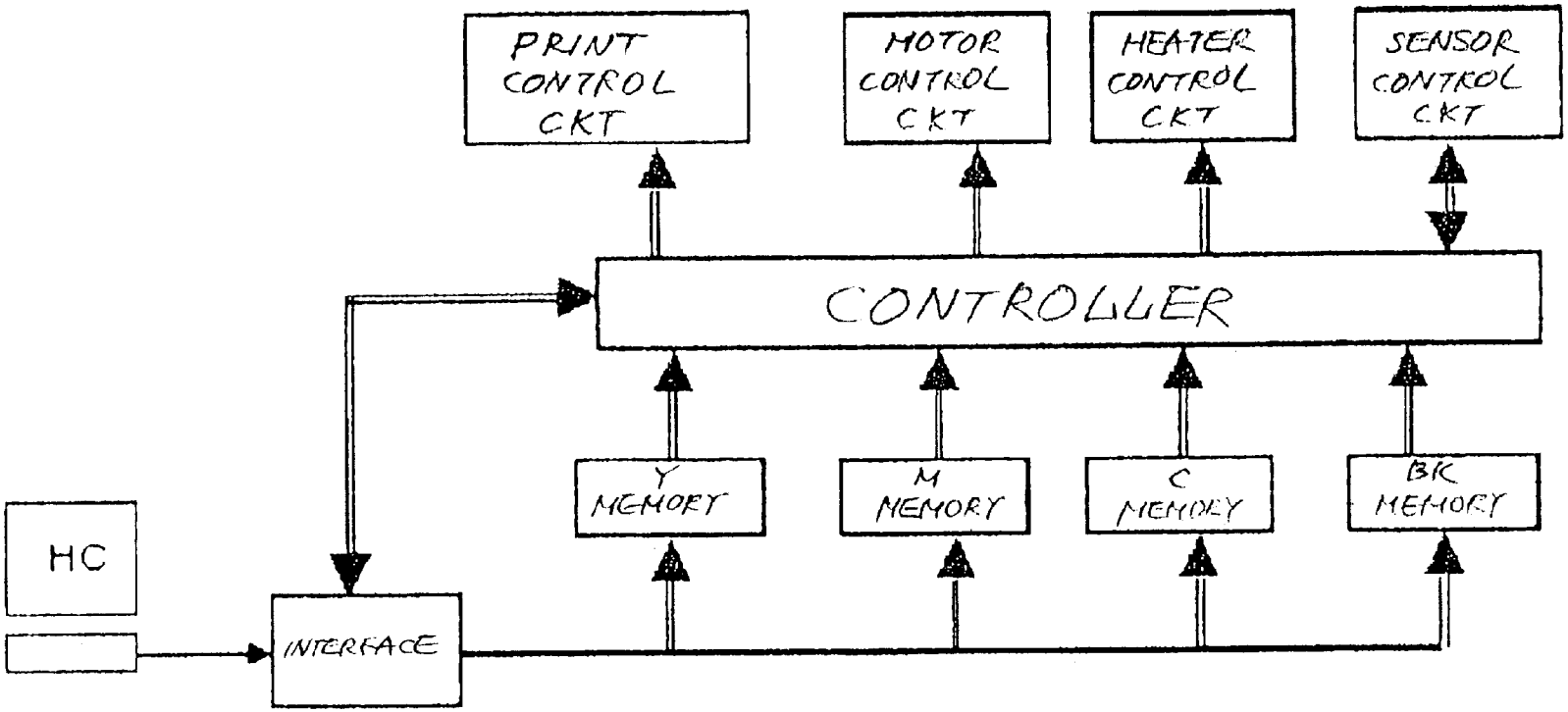
FIG. 30 is a schematic block diagram showing a specific control system of the present invention.
Figure 31:
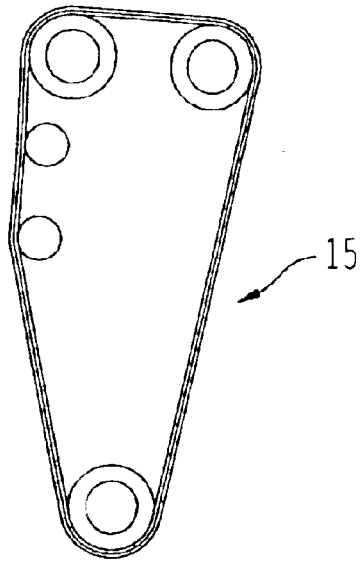
FIG. 31 illustrates an endless belt having a heat resistant base covered with a parting layer.
Figure 32:
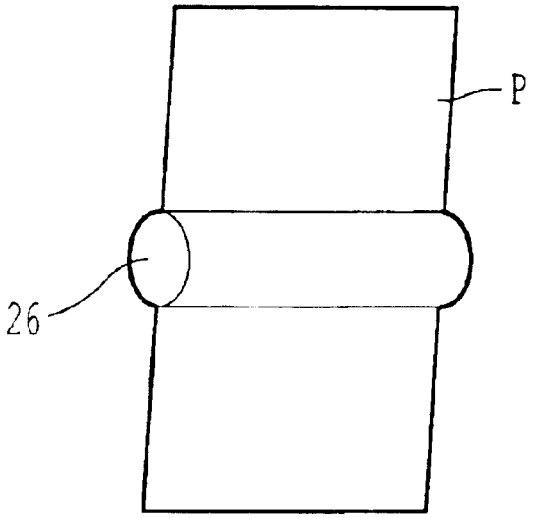
FIG. 32 illustrates a registration roller contacting an image recording medium.

FIG. 30 shows a specific control system configured to control the image forming network described with reference to FIGS. 10 and 11. As shown, data output from the host computer HC are sent to a controller via an interface. The controller controls, e.g., printing conditions in accordance with the data received from the host computer.

As stated above, the sixth embodiment insures accurate register of images in the duplex print mode and obviates the curl of the belt, thereby obviating defective images including blurred images.

Various modifications will become possible for those skilled in the art after receiving the teachings of the present disclosure without departing from the scope thereof.

What is claimed is:

1. An image forming method comprising the steps of electrostatically transferring toner images of different colors each being formed on a particular one of a plurality of image carriers to a first intermediate image transfer body one above the other to thereby form a first composite image;

electrostatically transferring the first composite image to a second intermediate image transfer body;

electrostatically transferring the first composite image from said second intermediate image transfer body to one side of a recording medium;

electrostatically transferring to the other side of the recording medium a second composite image formed on said first intermediate image transfer body by transferring toner images of different colors formed on said plurality of image carriers one above the other; and fixing the first composite image and the second composite image of the recording medium at the same time.

2. The method as claimed in claim 1, further comprising fixing the first composite image and the second composite image at the same time by using first heating means and second heating means respectively positioned outside and inside of said second intermediate image transfer body.

3. An image forming apparatus comprising:

a plurality of image carriers on each of which a toner image of a particular color is formed;

a first intermediate image transfer body to which toner images of different colors formed on said plurality of image carriers are transferred one above the other to thereby form a first composite image;

a second intermediate image transfer body to which the first composite image is transferred;

first image transferring means for electrostatically transferring the toner images from said plurality of image carriers to said first intermediate image transfer body;

second image transferring means for electrostatically transferring the first composite image from said first intermediate image transfer body to said second intermediate image transfer body;

third image transferring means for transferring the first composite image from said second image transfer body to one side of a recording medium;

fourth image transferring means for transferring to the other side of the recording medium a second composite image formed on said first intermediate image transfer body by transferring toner images of different colors respectively formed on said plurality of image carriers; and fixing means for fixing the first composite image and the second composite image of the recording medium.

4. The apparatus as claimed in claim 3, wherein said second image transferring means bifunctions as said fourth image transferring means.

5. The apparatus as claimed in claim 3, wherein said third image transferring means faces, but does not contact, a surface of said second intermediate image transfer body.

6. The apparatus as claimed in claim 3, wherein said first intermediate image transfer body and said second intermediate image transfer body each comprise an endless belt passed over a plurality of support members and driven to move.

7. The apparatus as claimed in claim 3, wherein said second intermediate image transfer body comprises an endless belt passed over a plurality of support members and driven to move, and said second image transferring means and said fourth image transferring means are disposed in a loop of the endless belt.

8. The apparatus as claimed in claim 3, wherein said first intermediate image transfer body comprises an endless belt passed over a plurality of support members and driven to move, and said second image transferring means and said fourth image transferring means are disposed in a loop of the endless belt.

9. The apparatus as claimed in claim 3, wherein said first intermediate image transfer body comprises an endless belt passed over a plurality of support members and driven to move, said first intermediate image transfer body has a height smaller than a width in a horizontal direction, and a path for conveying the recording medium and said first intermediate image transfer body are positioned relative to each other such that said recording medium passes one end of said first intermediate image transfer body in the horizontal direction.

10. The apparatus as claimed in claim 3, wherein said first intermediate image transfer body comprises an endless belt passed over a plurality of support members and driven to move, said first intermediate image transfer body has a height smaller than a width in a horizontal direction, said second intermediate image transfer body is positioned below said first intermediate image transfer body, and a path for conveying the recording medium, said first intermediate image transfer body and said second intermediate image transfer body are positioned relative to each other such that said recording medium passes a nip between said first intermediate image transfer body and said second intermediate image transfer body in a substantially horizontal direction.

11. The apparatus as claimed in claim 10, further comprising a manual sheet feeding section, wherein a path for conveying the recording medium substantially linearly extends from said manual sheet feeding section to a tray to which the recording medium passed through said fixing means is driven out.

12. The apparatus as claimed in claim 3, wherein said first intermediate image transfer body comprises an endless belt passed over a plurality of support members and driven to move, and said plurality of image carriers are arranged side by side along either one of an upper run and a lower run of said first intermediate image transfer body.

13. The apparatus as claimed in claim 3, further comprising a tray positioned above said first intermediate image transfer body for stacking the recording medium passed through said fixing means, wherein said tray is inclined such that a downstream portion in a direction in which the recording medium is discharged to said tray is higher in level than an upstream portion, and said first intermediate image transfer body comprises an endless belt passed over a plurality of support members and has an upper run substantially parallel to said tray.

14. The apparatus as claimed in claim 3, wherein a path for conveying the recording medium extends such that said recording medium is conveyed from below an image transfer position where the image is to be transferred to said recording medium, and said fixing means is positioned above said image transfer position.

15. The apparatus as claimed in claim 3, further comprising a recording medium feeding device for feeding the recording medium toward an image transfer position where the image is to be transferred to said recording medium is positioned in a range below said image transfer position, wherein said second image transfer body comprises an endless belt passed over a plurality of support members and driven to rotate, and said fixing means has a fixing portion facing a surface portion of said second intermediate image transfer body that supports the recording medium moving toward said fixing means via a nip between said first intermediate image transfer body and said second intermediate image transfer body or substantially an extension of said surface.

16. The apparatus as claimed in claim 3, further comprising registering means for conveying the recording medium to an image transfer position where the image is to be transferred at a preselected timing, wherein a portion of said second intermediate image transfer body below the image transfer position is set back from a vertical line passing through said image transfer position away from said registering means so as not to interfere with said registering means.

17. The apparatus as claimed in claim 3, further comprising registering means for conveying the recording medium to an image transfer position where the image is to be transferred at a preselected timing, at least one of a portion of said first intermediate image transfer body and a portion of said second intermediate image transfer body upstream of the image transfer position in a direction of recording medium conveyance is set back from a horizontal line passing through said image transfer position away from said registering means so as not to interfere with said registering means.

18. The apparatus as claimed in claim 3, wherein said second intermediate image transfer body comprises an endless belt passed over a plurality of support members and driven to move, and said fixing means comprises heating means disposed in a loop of the endless belt.

19. The apparatus as claimed in claim 18, further comprising cooling means configured to cool said second intermediate image transfer body at a position downstream of said fixing means in a direction in which said second intermediate image transfer body moves, but upstream of an image transfer position where the image is to be transferred to the recording medium.

20. The apparatus as claimed in claim 3, wherein said second intermediate image transfer body comprises an endless belt comprising a heat-resistant base coated whose surface is covered with a parting layer.

21. The apparatus as claimed in claim 20, further comprising cooling means configured to cool said second intermediate image transfer body at a position downstream of said fixing means in a direction in which said second intermediate image transfer body moves, but upstream of an image transfer position where the image is to be transferred to the recording medium.

22. The apparatus as claimed in claim 3, further comprising a housing made up of a stationary housing and a movable housing openable relative to said stationary housing at a boundary defined by a path for conveying the recording medium, wherein said fixing means comprises first heating means and second heating means between which the recording medium passes, said first heating means and second heating means are respectively mounted on said stationary housing and said movable housing such that when said movable housing is opened, said first heating means and said second heating means are moved away from each other, and said first intermediate image transfer body and said second intermediate image transfer body are respectively mounted on said stationary housing and said movable housing such that when said movable housing is opened, said first intermediate image transfer body and said second intermediate image transfer body are moved away from each other.

23. The apparatus as claimed in claim 22, wherein said third image transferring means is mounted on said stationary housing such that when said movable housing is opened, said third image transferring means is exposed to an outside of said housing.

24. The apparatus as claimed in claim 22, wherein when said movable housing is opened, at least one of said first intermediate image transfer body and said second intermediate image transfer body is removable from said housing.

25. The apparatus as claimed in claim 3, further comprising a housing made up of a stationary housing and a movable housing openable relative to said stationary housing at a boundary defined by a path for conveying the recording medium, wherein said first intermediate image transfer body and said second intermediate image transfer body are respectively mounted on said movable housing and said stationary housing such that when said movable housing is opened, said first intermediate image transfer body and said second intermediate image transfer body are moved away from each other.

26. The apparatus as claimed in claim 25, wherein said third image transferring means is mounted on said movable housing such that when said movable housing is opened, said third image transferring means is exposed to an outside of said housing.

27. The apparatus as claimed in claim 25, wherein when said movable housing is opened, at least one of said first intermediate image transfer body and said second intermediate image transfer body is removable from said housing.

28. The apparatus as claimed in claim 3, wherein said first intermediate image transfer body and said second intermediate image transfer body each comprise an endless belt passed over a plurality of support members and driven to move, said first intermediate image transfer body has a height smaller than a width in a horizontal direction, said second intermediate image transfer body has a height greater than a width in the horizontal direction, and a path for conveying the recording medium and said first intermediate image transfer body are positioned relative to each other such that said recording medium passes one end of said first intermediate image transfer body in the vertical direction, said apparatus further comprising:

registering means for conveying the recording medium toward an image transfer position where the image is to be transferred to said recording medium at a preselected timing, said registering means being positioned in a range between said image transfer position and a bottom of said second intermediate image transfer body in a direction of height; and a first recording medium feeding device and a second recording medium feeding device configured to feed the recording medium each, wherein said first recording medium feeding device is positioned below said first intermediate image transfer body, said second recording medium feeding device is positioned such that a leading edge of the recording medium fed therefrom lies in a range below said second intermediate image transfer body, and said second recording medium feeding device protrudes to an outside of a housing of said apparatus.

29. The apparatus as claimed in claim 28, further comprising an exposing device positioned below said first intermediate image transfer body for exposing said plurality of image carriers to thereby form latent images on said plurality of image carriers.

30. The apparatus as claimed in claim 28, wherein said housing comprises a stationary housing and a movable housing openable relative to said stationary housing, and assuming that a path extending from said first recording medium feeding device to said registering means is a first path, and that a path extending from said second recording medium feeding means to said first path is a second path, then said movable housing is positioned relative to said first path and said second path such that when said movable housing is opened, said first path and said second path both are uncovered.

31. The apparatus as claimed in claim 30, wherein said registering means comprises a registration roller pair made up of a first roller and a second roller that are respectively mounted on said stationary housing and said movable housing, said apparatus further comprising:

first impurity removing means and second impurity removing means for respectively cleaning a surface of said first roller and a surface of said second roller; and a first impurity storing member and a second impurity storing member for respectively storing impurities collected by said first impurity removing means and said second impurity removing means, wherein said first impurity storing member and said second impurity storing member are positioned at opposite sides of said first path, and said first impurity removing means and said first impurity storing member are mounted on said stationary housing while said second impurity removing means and said second impurity storing member are mounted on said movable housing.

32. The apparatus as claimed in claim 30, further comprising:

a cleaning unit for cleaning a surface of said second intermediate image transfer body; and a waste toner storing member for storing toner, which is left on said second intermediate image transfer body after image transfer, collected by said cleaning unit, wherein said waste toner storing member and said cleaning unit are mounted on said movable housing with said waste toner storing member adjoining said second impurity storing member.

33. The apparatus as claimed in claim 32, wherein when said movable housing is opened, at least one of said waste toner storing member and said second impurity storing member is removable from said movable housing.

34. The apparatus as claimed in claim 32, wherein said waste toner storing member and said second impurity storing member are constructed integrally with each other.

35. The apparatus as claimed in claim 32, wherein said first impurity storing member, said second impurity storing member and said waste toner storing member serve as guides for guiding the recording medium being conveyed.

36. The apparatus as claimed in claim 30, wherein said second path has a radius of curvature of 40 mm or above.

37. The apparatus as claimed in claim 28, wherein said first roller and said second roller of said registration roller pair contact the recording medium over an entire width of said recording medium.

38. The apparatus as claimed in claim 3, further comprising an outlet roller pair for conveying the recording medium coming out of said fixing means to a tray, wherein a path extending from said fixing means to said outlet roller pair has a radius of curvature of 40 mm or above.

39. The apparatus as claimed in claim 3, further comprising:

a plurality of toner containers respectively storing toner of different colors to be replenished to a plurality of developing units; and a space for accommodating said plurality of toner containers at a position below a tray on which the recording medium passed through said fixing means is to be stacked, but above said first intermediate image transfer body;

wherein said tray is openable to allow said plurality of toner containers stored in said space to be replaced.

40. The apparatus as claimed in claim 39, further comprising protecting means for protecting the toner stored in said plurality of toner containers from heat.

41. The apparatus as claimed in claim 40, wherein said protecting means comprises a heat insulating member intervening between said space and said fixing means.

42. The apparatus as claimed in claim 40, wherein said protecting means bifunctions as heat insulating means intervening between a cleaning unit, which cleans a surface of said first intermediate image transfer body after transfer of the first image and the second image, and said fixing means.

43. The apparatus as claimed in claim 40, wherein said protecting means comprises means for causing air to flow between said space and said fixing means.

44. The apparatus as claimed in claim 40, wherein said protecting means comprises a cover surrounding at least one of said plurality of toner containers.

45. The apparatus as claimed in claim 3, further comprising:

a plurality of toner containers respectively storing toner of different colors to be replenished to a plurality of developing units;

a space for accommodating said plurality of toner containers at a position below a tray on which the recording medium passed through said fixing means is to be stacked, but above said first intermediate image transfer body; and a door positioned below a tray on which the recording medium passed through said fixing means is to be stacked, and openable to allow said plurality of toner containers stored in said space to be replaced.

46. The apparatus as claimed in claim 45, further comprising protecting means for protecting the toner stored in said plurality of toner containers from heat.

47. The apparatus as claimed in claim 46, wherein said protecting means comprises a heat insulating member intervening between said space and said fixing means.

48. The apparatus as claimed in claim 46, wherein said protecting means bifinctions as heat insulating means intervening between a cleaning unit, which cleans a surface of said first intermediate image transfer body after transfer of the first image and the second image, and said fixing means.

49. The apparatus as claimed in claim 46, wherein said protecting means comprises means for causing air to flow between said space and said fixing means.

50. The apparatus as claimed in claim 46, wherein said protecting means comprises a cover surrounding at least one of said plurality of toner containers.

51. The apparatus as claimed in claim 3, further comprising a reading unit for reading a document, said reading unit being positioned above a tray on which the recording medium passed through said fixing means is to be stacked.

52. The apparatus as claimed in claim 51, wherein said reading unit comprises first reading means and second reading means for respectively reading images printed on both sides of the document while said document is in conveyance.

53. The apparatus as claimed in claim 3, wherein said apparatus is selectively operable in a mode in which the first image and the second image are transferred to opposite sides of the recording medium or a mode in which a composite toner image formed on said first intermediate image transfer body is directly transferred to the recording medium and said recording medium carrying only said composite toner image is passed through said fixing means.

54. The apparatus as claimed in claim 3, further comprising a tray on which the recording medium passed through said fixing means is to be stacked, wherein said tray, said first intermediate image transfer body and said second intermediate image transfer body are positioned relative to each other such that said recording medium is stacked on said tray with the image transferred from said first intermediate image transfer body facing downward.

55. The apparatus as claimed in claim 3, further comprising a first tray and a second tray to which the recording medium passed through said fixing means is selectively stacked, wherein said first tray, said second tray, said first intermediate image transfer body and said second intermediate image transfer body are positioned relative to each other such that the image transferred from said first intermediate image transfer body to the recording medium faces downward when said recording medium is stacked on said first tray or faces upward when said recording medium is stacked on said second tray, and switching means is provided for steering the recording medium to either one of said first tray and said second tray.

56. The apparatus as claimed in claim 3, wherein said apparatus is selectively operable in a mode in which the first image and the second image are transferred to opposite sides of the recording medium or a mode in which a composite toner image formed on said first intermediate image transfer body is transferred to said recording medium by way of said second intermediate image transfer body and said recording medium carrying only said composite toner image is passed through said fixing means.

57. The apparatus as claimed in claim 3, wherein said apparatus is operable in a mode in which the toner image is transferred from any one of said plurality of image carriers to said first intermediate image transfer body and then transferred from said first intermediate image transfer body to the recording medium.

58. The apparatus as claimed in claim 3, wherein said first intermediate image transfer body has a higher volume resistance than said second intermediate image transfer body.

59. The apparatus as claimed in claim 3, wherein said first intermediate image transfer body has a higher surface resistivity than said second intermediate image transfer body.

60. An image forming system comprising:

an image forming apparatus; and a host connected to said image forming apparatus;

said image forming apparatus comprising:

a plurality of image carriers on each of which a toner image of a particular color is formed;

a first intermediate image transfer body to which toner images of different colors formed on said plurality of image carriers are transferred one above the other to thereby form a first composite image;

a second intermediate image transfer body to which the first composite image is transferred;

first image transferring means for electrostatically transferring the toner images from said plurality of image carriers to said first intermediate image transfer body;

second image transferring means for electrostatically transferring the first composite image from said first intermediate image transfer body to said second intermediate image transfer body;

third image transferring means for transferring the first composite image from said second image transfer body to one side of a recording medium;

fourth image transferring means for transferring to the other side of the recording medium a second composite image formed on said first intermediate image transfer body by transferring toner images of different colors respectively formed on said plurality of image carriers; and fixing means for fixing the first composite image and the second composite image of the recording medium.

61. An image forming apparatus comprising:

a plurality of image carriers;

a first intermediate image transfer body;

a second intermediate image transfer body; and control means for controlling an image forming process;

wherein a composite toner image formed on said first intermediate image transfer body by transferring toner images of different color from said plurality of image carriers is transferred to said second intermediate image transfer body and then from said second intermediate image transfer body to one side of a recording medium while a next composite toner image is transferred from said first intermediate image transfer body to the other side of said recording medium, and said control means adjoins at least one of said first intermediate image transfer body and said second intermediate image transfer body.

62. The apparatus as claimed in claim 61, wherein said second intermediate image transfer body comprises a 50 $\mu$m to 500 $\mu$m thick base formed of polyimide or polyamide-imide and a 1.5 mm to 3 mm thick rib formed of rubber and provided on said rib for preventing said second intermediate image transfer body from skewing.

63. The apparatus as claimed in claim 61, further comprising:

a host capable of setting and controlling the image forming process.

64. An image forming apparatus comprising:

a plurality of image carriers;

a first intermediate image transfer body;

a second intermediate image transfer body;

a plurality of image forming means each for forming a toner image of a particular color on a particular one of said plurality of image carriers;

first control means adjoining said first intermediate image transfer body for controlling an image forming process; and second control means adjoining said second intermediate image transfer body for controlling the image forming process, wherein a composite toner image formed on said first intermediate image transfer body by transferring toner images of different color from said plurality of image carriers is transferred to said second intermediate image transfer body and then from said second intermediate image transfer body to one side of a recording medium while a next composite toner image is transferred from said first intermediate image transfer body to the other side of said recording medium.

65. The apparatus as claimed in claim 64, wherein said first intermediate image transfer body and said second intermediate image transfer body each comprise an endless belt, and said first control means and said second control means are respectively disposed in a loop of said first intermediate image transfer body and a loop of said second intermediate image transfer body.

66. The apparatus as claimed in claim 65, wherein said first control means and said second control means each comprise a timing mark positioned on an inner surface of the belt and sensing means for sensing said timing mark.

67. The apparatus as claimed in claim 66, wherein said timing mark comprises a mark printed on the inner surface of the belt.

68. The apparatus as claimed in claim 66, wherein said timing mark is formed on a rib provided on an inner surface of the belt.

69. The apparatus as claimed in claim 66, wherein said timing mark comprises a recess formed in a rib provided on an edge of an inner surface of the belt for preventing said belt from skewing.

70. The apparatus as claimed in claim 66, wherein said timing mark is formed on a rib provided on an edge of an inner surface of the belt for preventing said belt from skewing and is visible from a side of said belt.

71. The apparatus as claimed in claim 66, wherein said sensing means comprises non-contact type sensing means located at a side of the belt.

72. The apparatus as claimed in claim 66, wherein said plurality of image carriers are arranged side by side along said first intermediate image transfer body, toner images formed on said plurality of image carriers by said plurality of image forming means are transferred to said first intermediate image transfer body one above the other to form a composite toner image, and formation of images on said plurality of image carriers is controlled on the basis of an output of said sensing means of said first control means representative of said timing mark.

73. The apparatus as claimed in claim 66, wherein a timing for transferring the toner images from said plurality of image carriers to said first intermediate image transfer body is controlled on the basis of an output of said sensing means of said first control means representative of said timing mark.

74. The apparatus as claimed in claim 66, wherein a timing for transferring the composite toner image from said first intermediate image transfer body to said second intermediate image transfer body is controlled on the basis of an output of said sensing means of said first control means representative of said timing mark.

75. The apparatus as claimed in claim 66, wherein conveyance of the recording medium is controlled on the basis of an output of said sensing means of said first control means and an output of said sensing means of said second control means representative of said timing mark.

76. The apparatus as claimed in claim 64, wherein said second intermediate image transfer body comprises a 50 $\mu$m to 500 $\mu$m thick base formed of polyimide or polyamide-imide and a 1.5 mm to 3 mm thick rib formed of rubber and provided on said rib for preventing said second intermediate image transfer body from skewing.

77. The apparatus as claimed in claim 64, further comprising:

a host capable of setting and controlling the image forming process.

78. An image forming apparatus comprising:

a plurality of image carriers;

a first intermediate image transfer body;

a second intermediate image transfer body comprising an endless belt;

a plurality of image forming means each for forming a toner image of a particular color on a particular one of said plurality of image carriers;

a timing mark provided on said second intermediate image transfer body; and sensing means adjoining said second intermediate image transfer body for sensing said timing mark, wherein a composite toner image formed on said first intermediate image transfer body by transferring toner images of different color from said plurality of image carriers is transferred to said second intermediate image transfer body and then from said second intermediate image transfer body to one side of a recording medium while a next composite toner image is transferred from said first intermediate image transfer body to the other side of said recording medium, and a movement of said second intermediate image transfer body is stopped after an image forming process on the basis of an output of said sensing means representative of said timing mark.

79. The apparatus as claimed in claim 78, further comprising stop data storing means for storing a last stop position of said second intermediate image transfer body, wherein said second intermediate image transfer body is so controlled on the basis of said last stop position as not to stop at a position coincident with said last stop position.

80. The apparatus as claimed in claim 79, wherein to stop said second intermediate image transfer belt, a motor is controlled on the basis of a period of time counted by a counter since a time when said sensing means has sensed said timing mark.

81. The apparatus as claimed in claim 78, wherein said second intermediate image transfer body is driven by a stepping motor.

82. The apparatus as claimed in claim 78, wherein a stop of said second intermediate image transfer body is controlled in a particular manner in each of a simplex print mode and a duplex print mode.

83. The apparatus as claimed in claim 78, wherein image transferring means for transferring the composite toner image from said second intermediate image transfer body to the one side of the recording medium does not contact the recording medium.

84. The apparatus as claimed in claim 78, wherein said second intermediate image transfer body comprises a 50 $\mu$m to 500 $\mu$m thick base formed of polyimide or polyamide-imide and a 1.5 mm to 3 mm thick rib formed of rubber and provided on said rib for preventing said second intermediate image transfer body from skewing.

85. The apparatus as claimed in claim 78, further comprising:

a host capable of setting and controlling the image forming process.

* * * * *